US006134399A

United States Patent [19]

Hino et al.

[11] Patent Number: 6,134,399

[45] Date of Patent: Oct. 17, 2000

[54] IMAGE FORMING APPARATUS HAVING MEANS FOR JUDGING WHETHER OR NOT A RECORDING SHEET OVELAPS A BELT SEAM

[75] Inventors: Hideki Hino, Toyokawa; Yoshiaki Takano, Toyohashi; Kazuo Okunishi, Okazaki; Kentaro Nagatani, Toyohashi, all of Japan

[73] Assignee: Minolta Co., Ltd., Osaka, Japan

[21] Appl. No.: 09/196,236

[22] Filed: Nov. 20, 1998

[30] Foreign Application Priority Data

Nov. 21, 1997 [JP] Japan ..... 9-321793

[51] Int. Cl.[7] ..... G03G 15/14

[52] U.S. Cl. ..... 399/66; 358/296; 399/303; 399/389

[58] Field of Search ..... 399/303, 302, 399/301, 300, 299, 298, 388, 389, 394, 43, 66; 358/501, 401, 296; 347/116, 115

[56] References Cited

U.S. PATENT DOCUMENTS 5,477,250 12/1995 Larson .
5,629,760 5/1997 Hayashi et al. ..... 399/299 X
5,784,674 7/1998 Iseki et al. ..... 399/299 X

FOREIGN PATENT DOCUMENTS 05002347 8/1993 Japan .
6-35262 2/1994 Japan .
8-194393 7/1996 Japan .

*Primary Examiner*—Sophia S. Chen
*Attorney, Agent, or Firm*—McDermott, Will & Emery

[57] ABSTRACT

An image forming apparatus includes an endless transporting member having an portion which is not suitable for forming an image, a feeder for feeding the recording sheet to the transporting member, and a judge member which judges whether or not the recording sheet has an overlap-permissible region which allows to overlap the portion. The recording sheet is fed to the transporting member based on a judged result of the judge member so that the portion is located in the overlap-permissible region, or so that the portion is not located in the overlap-permissible region.

25 Claims, 21 Drawing Sheets

| | | |
|---|---|---|
| VALID / INVALID | $X_1$ | $W_1$ |
| VALID / INVALID | $X_2$ | $W_2$ |
| VALID / INVALID | $X_3$ | $W_3$ |
| | . . . | |
| VALID / INVALID | $X_i$ | $W_i$ |

IMAGE FORMING APPARATUS HAVING MEANS FOR JUDGING WHETHER OR NOT A RECORDING SHEET OVELAPS A BELT SEAM

BACKGROUND OF THE INVENTION

1. Field of the Invention

The present invention relates to an image forming apparatus, for example, an electrophotography type, an electrostatic recording type image forming apparatus, or the like, and more particularly, to a color image forming apparatus such as a color copying machine, a color printer, or the similar apparatus, wherein a plurality of image forming members are provided to form a plurality of images, each different in color, on respective image storing members, and then these images are transferred, one on another, in turn, on the same recording sheet held and transported by a recording sheet transporting member.

2. Description of the Related Art

In an image forming apparatus which includes an endless image-transfer belt having a seam and which transfers an image to a recording sheet held on the image-transfer belt from a photosensitive drum, if image transferring is performed when the recording sheet is located on the seam, a portion of the image may not be transferred on the recording sheet, resulting in a poor image.

In order to solve the problem, an image forming apparatus has been proposed by, for example, Japanese Unexamined Laid-open Patent Publication No. H6(1994)-35262. The image forming apparatus is provided with a seam detector for detecting the seam and an image detector for detecting the image status. In the image forming apparatus, when no image, or when character images, line images, or single-color images are to be transferred to the recording sheet, it is assumed that the seam does not cause a poor image transfer. Therefore, the recording sheet is fed regardless of the seam. In other cases, the recording sheet is fed so as not to be located on the seam.

However, in the above-mentioned conventional image forming apparatus, though poor image transferring seldom occurs when the image only consists of characters, lines or a single-color, a poor image transferring still may occur when a portion of a character is located on the seam, especially when the character is very small.

On the other hand, when transferring a color image including a character and a picture, when the size of the image is smaller than that of the recording sheet, or when the image has, at its center portion, a blank area(so called "center erase of 2 in 1"), if the blank area portion is located on the seam, no problem will occur when transferring an image. Nevertheless, the recording sheet will be fed such that the recording sheet is not positioned on the seam even though image consists of characters, lines or a single-color. This causes decreased efficiency for feeding the recording sheet, resulting in decreased productivity for the whole apparatus.

SUMMARY OF THE INVENTION

It is an object of the present invention to provide an image forming apparatus which can feed a recording sheet to the recording sheet transporting member without causing a poor image on the recording sheet due to a seam of the recording sheet transporting member.

It is another object of the present invention to provide an image forming apparatus having improved recording sheet feeding efficiency, resulting in improved productivity for the whole apparatus.

According to the present invention, the recording sheet can be fed to the recording sheet transporting member so as to avoid a seam of the recording sheet transporting member. In addition, in a case where an overlap-permissible region, which permits to overlap the seam, is to be formed on the recording sheet, the recording sheet is fed to the recording sheet transporting member such that the overlap-permissible region is located on the seam.

According to one aspect of the present invention, an image forming apparatus includes:

- a recording sheet transporting member which has a specific portion and transports a recording sheet while holding the recording sheet thereon, the transporting member being endless;
- a recording sheet feeding member which feeds the recording sheet to the recording sheet transporting member;
- a judge means which judges whether or not an overlap-permissible region, which permits to overlap the specific portion, is to be formed on the recording sheet;
- a controller which controls, based on a judged result of said judge means, a feeding of the recording sheet to the recording sheet transporting member so that the overlap-permissible region overlaps the specific portion, or so that the recording sheet does not overlap the specific portion.

In the image forming apparatus, based on an image status, a size of the image, etc., the judge means judges whether or not the overlap-permissible region is to be formed on the recording sheet. If the judge means judges the overlap-permissible region is to be formed on the recording sheet, the recording sheet is fed to the recording sheet transporting member so that the overlap-permissible region overlaps the specific portion. On the other hand, if the judge means does not judge the overlap-permissible region is to be formed on the recording sheet, the recording sheet is fed to the recording sheet transporting member so that the recording sheet does not overlaps the specific portion. Therefore, even thought the image consists of characters, lines or a single-color, if the judge means does not judge the overlap-permissible region is to be formed on the recording sheet, the recording sheet is fed to the recording sheet transporting member so that the recording sheet does not overlaps the specific portion. This can prevent a poor image transfer.

On the other hand, in a case where a color image consisting of a character and a picture such as a photograph is to be transferred, conventionally the recording sheet is fed to the recording sheet transporting member so that the recording sheet is not located on the specific portion. In contrast, in the present invention, if the judge means judges the overlap-permissible region is to be formed on the recording sheet, the recording sheet is fed to the recording sheet transporting member so that the overlap-permissible region overlaps the specific portion. Accordingly, the efficiency for feeding the recording sheet can be improved, resulting in improved productivity for the whole apparatus.

The overlap-permissible area may be formed by, for example, a blank region of the image or a smaller size image which is smaller than the size of the recording sheet.

Other objects and the features will be apparent from the following detailed description of the invention with reference to the attached drawings.

BRIEF DESCRIPTION OF THE INVENTION

The present invention will be more fully described and better understood from the following description, taken with the appended drawings, in which.

DETAILED DESCRIPTION OF THE PREFERRED EMBODIMENTS

Preferred embodiments of the present invention will now be described, in detail, with reference to the accompanying drawings.

Figure 1:
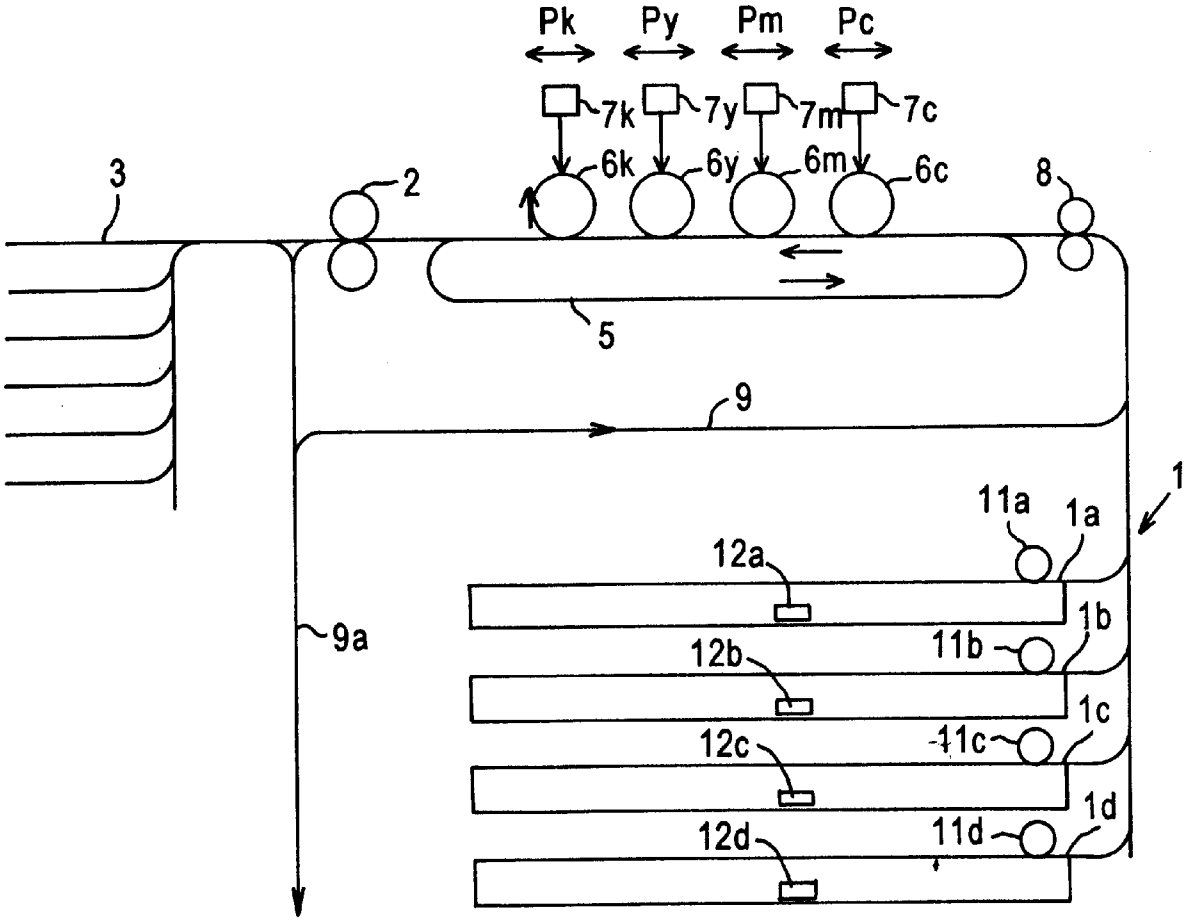
FIG. 1 is a schematic view of a major portion of an image forming unit of a full color image forming apparatus according to an embodiment of the present invention.

FIG. 1 schematically shows a major part of an image forming unit of an electrophotography type full-color copying machine according to one embodiment of the present invention. The present invention can also be applied to various other types of image forming apparatus of electrophotography type, electrostatic recording type, or similar types, other than that of this embodiment. For example the present invention may be applied to the image forming apparatus disclosed in the U.S. Pat. No. 5,477,250, which employs a non-electrophotography process.

The image forming apparatus includes four image forming units Pc, Pm, Py, Pk. Disposed below the image forming units is a paper-supply unit 1. At the left side of the image forming units, a fixing device 2 is disposed. At the left side of the fixing device 2, a sorter 3 is disposed. The sorter 3 has functions such as stapling and tray-shifting.

Between the paper-supply unit 1 and the fixing device 2, a circulation path 9 which circularly conveys a paper as a recording sheet is formed. A paper inverting unit 9*a* for inverting and transferring a paper is provided in the circulation path 9 between the fixing device 2 and the paper-supply unit 1. The paper inverting unit 9*a* also serves as a changing device which changes a paper from being introduced into the circulation path 9 for copying the reverse side of the paper into being discharged toward the sorter 3.

At the lower side of a transporting path between the paper-supply unit 1 and the fixing device 2, an endless belt 5 for holding and transporting a paper is provided such that the belt is supported and tensioned by a plurality of rollers (not shown) in a well known manner.

The belt 5 is driven in the direction of the arrows shown in FIG. 1. The belt holds and transports a paper fed from the paper-supply unit 1 to each of the image forming units Pc, Pm, Py, Pk in order.

Each of the image forming units Pc, Pm, Py, Pk, each having substantially the same construction, respectively, includes photosensitive drums 6*c*, 6*m*, 6*y*, 6*k*, each driven to rotate in the direction of the arrow shown in FIG. 1. At around each photosensitive drum, image forming elements (not shown) are disposed.

The above-mentioned image forming elements may be any desired structure. In this embodiment, an electrostatic charger for uniformly charging each photosensitive drum 6*c*, 6*m*, 6*y*, 6*k*, a developing device for developing electrostatic latent images formed on each photosensitive drum, a transferring charger for transferring a developed toner image on a paper, a cleaner for removing toner remaining on the photosensitive drum, are disposed around each photosensitive drum in order in the rotational direction thereof. Image exposing devices 7*c*, 7*m*, 7*y*, 7*k* are provided, respectively, above the photosensitive drums 6*c*, 6*m*, 6*y*, 6*k*.

In the developing devices of the image forming units Pc, Pm, Py, Pk, cyan color toner, yellow color toner, magenta color toner and black color toner are accommodated, respectively.

Each image exposing device 7*c*, 7*m*, 7*y*, 7*k* comprises a semiconductor laser, a polygon mirror, an fθ lense, etc. In the image exposing device, a laser beam, which is modulated in accordance with electric digital image signals, scans in the longitudinal direction on each photosensitive drum 6*c*, 6*m*, 6*y*, 6*k* at location between the electrostatic charger and the developing device to expose the drum surface, thereby forming an electrostatic latent image on each photosensitive drum. An image signal corresponding to a cyan color, a magenta color, a yellow color and a black color component of a color image is input into the respective image exposing device 7*c*, 7*m*, 7*y*, 7*k* of the respective image forming unit Pc, Pm, Py, Pk.

Between the image forming unit Pc and the paper-supply unit 1, a paper adhering member (not shown) is provided so that a paper fed from the paper-supply unit 1 is assuredly and electrically adhered on the belt 5. Between the image forming unit Pk and the fixing device 2, an erasing device (not shown) is provided to erase electrical charge to separate the paper adhering to the belt 5 therefrom.

The belt 5 is made of a resin film sheet having a semiconductor (or conductor) characteristic with opposite ends connected by melting, or the like, to create an endless belt. The belt 5 is endlessly driven at a constant velocity in the direction of the arrow by a driving roller (not shown). A seam of the belt 5 is regarded as an inappropriate portion for an image forming because the seam portion is different in thickness from the remaining portion, and thus exercises a harmful influence on copying an image onto such a paper from the photosensitive drums 6*c*, 6*m*, 6*y*, 6*k*. Accordingly, as will be mentioned later, when a paper is fed to the belt 5, control is required such that a paper is fed so as not to be located on the seam, or such that only a certain region of a paper is located on the seam during a special situation.

The paper-supply unit 1 comprises a plurality of paper-supply trays (for example, cassette type trays) 1*a*, 1*b*, 1*c*, 1*d* for storing different size papers, paper-supply rollers 11*a*, 11*b*, 11*c*, 11*d* each comprising a paper-supply member for supplying a paper one by one from each paper-supply tray 1*a*, 1*b*, 1*c*, 1*d*, timing rollers 8 as a feeding member for feeding a paper supplied from each paper-supply tray 1*a*, 1*b*, 1*c*, 1*d* onto the belt 5 at a certain time, and recording sheet information detectors 12*a*, 12*b*, 12*c*, 12*d*, which detects information on the recording sheet.

In the full color copying machine shown in FIG. 1, when a paper is transported from the timing rollers 8 onto the belt 5 while being guided by a paper transport guide (not shown), the paper assuredly electrostatically adhered to the belt 5 as a result of the effect of the paper adhering member. With the movement of the belt 5 in the direction of the arrows shown in FIG. 1, a visible image of cyan color (C) is formed on the photosensitive drum 6*c* of the image forming unit PC, a visible image of magenta color (M) is formed on the photosensitive drum 6*m* of the image forming unit Pm, a visible image of yellow color (Y) is formed on the photosensitive drum 6*y* of the image forming unit Py, and a visible image of black color (K) is formed on the photosensitive drum 6*k* of the image forming unit Pk, each visible image being formed separately. These visible images are transferred, one on another, onto a paper by the transferring charger of each image forming unit Pc, Pm, Py, Pk, in that order, when the paper passes under the photosensitive drum 6*c*, 6*m*, 6*y*, 6*k* of each image forming unit Pc, Pm, Py, Pk, in that order, toward the fixing device 2, in accordance with the movement of the belt 5, resulting in a composite color image. After the paper has passed the image forming unit Pk, the charged electricity of the paper is removed by the erasing device. Then the paper is detached from the belt 5. The paper detached from the belt 5 is discharged to the sorter 3 after the transferred multiple composite images are fixed by the fixing device 2.

In a case where the reverse side of the paper also is to be copied or printed for a two-sided copy, the paper is inverted at the paper inverting unit 9*a* without discharging to the sorter 3 and then transported to the circulation path 9. An image forming onto the reverse side of the paper is performed in the same way as mentioned above, and then the paper is discharged to the sorter 3.

Thus, one series of a copying cycle is completed.

Figure 2:
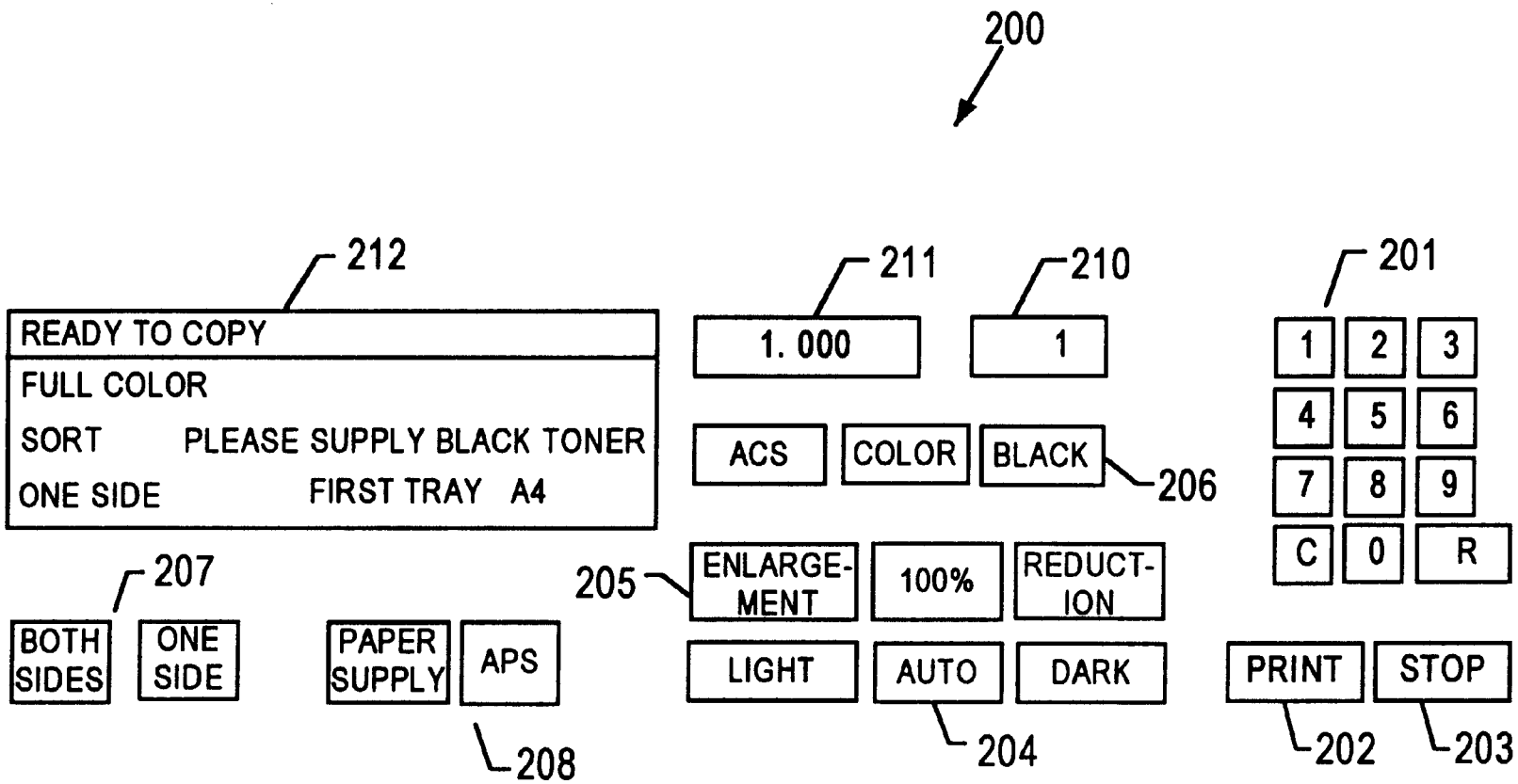
FIG. 2 is a plan view showing a portion of an operation panel according to an embodiment of the present invention.

FIG. 2 shows a part of the operation panel 200 of the full color copying machine shown in FIG. 1. This operation panel 200 enables the user to select a certain copy mode from various copy modes, start copying and recognize the set copy mode and the condition of the apparatus from the display.

A copy number setting portion 201 includes a plurality of keys for setting number of copies to be made and clearing the set number.

A key 202 marked as 'PRINT' is used to start copying. A key marked as 'STOP' is used to stop a copying operation. Darkness setting keys 204 are used to adjust the darkness of the image to be copied. Reduce/enlarge rate setting keys 205 are used to set a reduce/enlarge rate of the image to be copied. Color mode selecting keys 206 are used to set whether the image to be copied is printed in full color or only in black.

Copy side selection keys 207 are used to set whether the image to be copied is printed on one side of a paper or on both sides thereof. Tray select keys 208 are used to select one of four paper-supply trays.

A copy number display portion 210 displays number of copies to be made before the copy operation and number of remaining copies during the copy operation. A reduce/enlarge rate display portion 211 displays the set rate. A liquid crystal display portion 212 is a multi-purpose display portion which displays the set copy mode, the status of the apparatus and various information other than the information of the number of papers or the reduce/enlarge rate.

Figure 3:
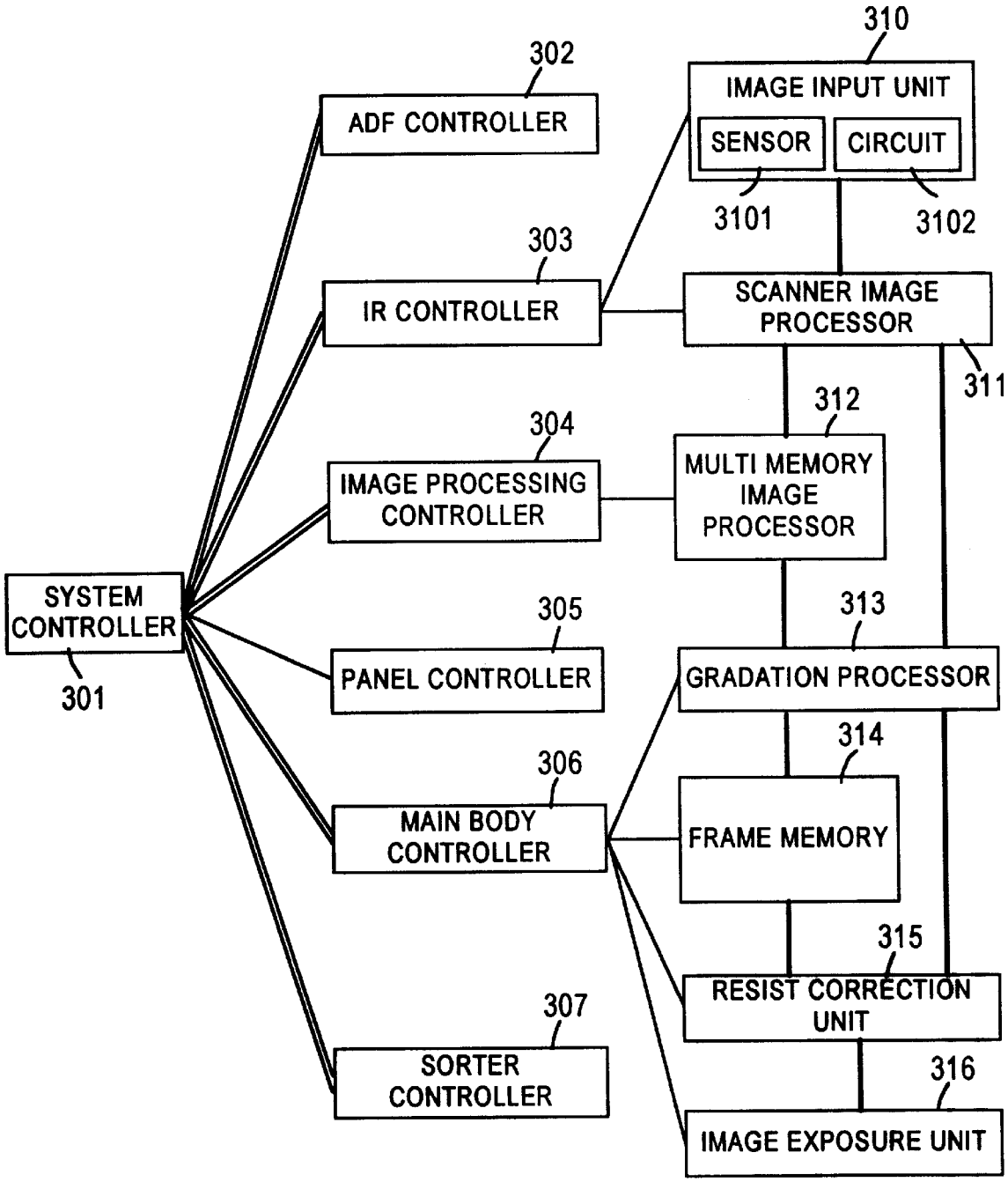
FIG. 3 is a block diagram showing a whole control of the apparatus according to an embodiment of the present invention.

FIG. 3 is a block diagram showing an overall control of a full color copying machine, such as the one shown in FIGS. 1 and 2.

The full color copying machine includes an image reader (IR) for reading an image information of a document as a function of a copying machine, an automatic document feeder (ADF) for automatically feeding a document one by one to an image reading portion of the image reader, in addition to the image forming main portion and the panel portion described in detail with FIGS. 1 and 2. However, the construction of the machine is not limited to the above.

A system controller 301 is a control portion which controls the whole copying machine.

An ADF controller 302 is a control portion which controls the automatic document feeder such that documents are fed one by one to the image reading portion of the image reader and are discharged to 20 a document discharge portion after the completion of the reading of the images.

An IR controller 303 is a control portion for controlling the scanning velocity and position of a scanner for reading an image of a document.

An image processing controller 304 is a control portion which operates a multi-memory image processor 312 depending on a copy sequence or a copy mode. Concretely, the image forming processing controller 304 controls the recording of an image signal processed by a scanner image processor 311 for every one page of the documents. Further, the image processor controller 304 controls the selecting of an image signal of the document stored for every one page in the order depending on a copy sequence, etc. and the sending of the stored image signal to a gradation processor 313. Furthermore, the image processing controller 304 controls a rotation of an image by 90 degrees or 180 degrees depending on a copy mode, etc.

A panel controller 305 is a control portion which processes and displays key inputs of the operation panel 200 as described with FIG. 2

A main body controller 306 is a control portion which controls the transportation of papers, the belt 5, the photosensitive drums 6*c*, 6*m*, 6*y*, 6*k*, the image forming elements disposed around the drums, the fixing device 2, etc., described in connection with FIG. 1. A more detailed explanation will be given later.

A sorter controller 307 is a control portion which controls the discharge of the papers in the sorter 3, the movement of bins, the position of the shift tray and the stapling operation.

An image input unit 310 includes a sensor 3101 comprising CCD and the like for reading an image of a document, a circuit 3102 which digitalizes the signal from the sensor. In this embodiment, each component of the color image C, M, Y and K is processed at the same time.

The scanner image processor 311 includes a circuit for reducing/enlarging, shifting, erasing the digitalized image signal depending on a copy mode, etc.

The multi-memory image processor 312 includes a memory for storing image information and a circuit for rotating or reducing/enlarging an image.

The gradation processor 313 includes a circuit which converts the tone data, for example, from eight tones to three tones, corresponding to a circuit.

A frame memory 314 includes a circuit which temporarily saves image signals of a plurality of pages when copying both sides and outputs an image signal of a required page at a required time.

A resist correction unit 315 includes a circuit which delays the image signals corresponding to each C, M, Y and K composition of the color image by a time corresponding to a timing gap of the paper passing below the image forming units Pc, Pm, Py, Pk in the order. By this circuit, the image signal of each C, M, Y and K component can be processed at the same time between the image input unit 310 and the gradation processor 313 or the frame memory 314.

The image exposure unit 316 corresponds to the reference numerals 7*c*, 7*m*, 7*y*, 7*k* shown in FIG. 1, and comprises a circuit which forms an electrostatic latent image of each C, M, Y and K component on the respective photosensitive drums 6*c*, 6*m*, 6*y*, 6*k* in response to a corresponding image signal.

A paper-feed timing for feeding the paper on the image-transfer belt (referred to simply as the belt) will be described as follows.

In this invention, the paper-feed timing for feeding the paper on the belt is determined so that an overlap-permissible region overlaps the seam, or so that the paper does not overlap the seam, which results in a decreased image quality, increased the paper-feed timing and enhanced productivity as compared to the conventional control in which the paper-feed timing is determined in accordance with the type of the image.

The method of the determination of the paper-feed timing will be described as follows.

In this method, in addition to the conventional paper-feed timing determination method in which the paper is not placed on the seam, a paper-feed timing determination method in which a non-image forming area (blank area) of the paper is placed on the seam is employed.

Now, a timing control of the feeding of the paper to the belt 5 so as to avoid the seam will be described.

Figure 4:
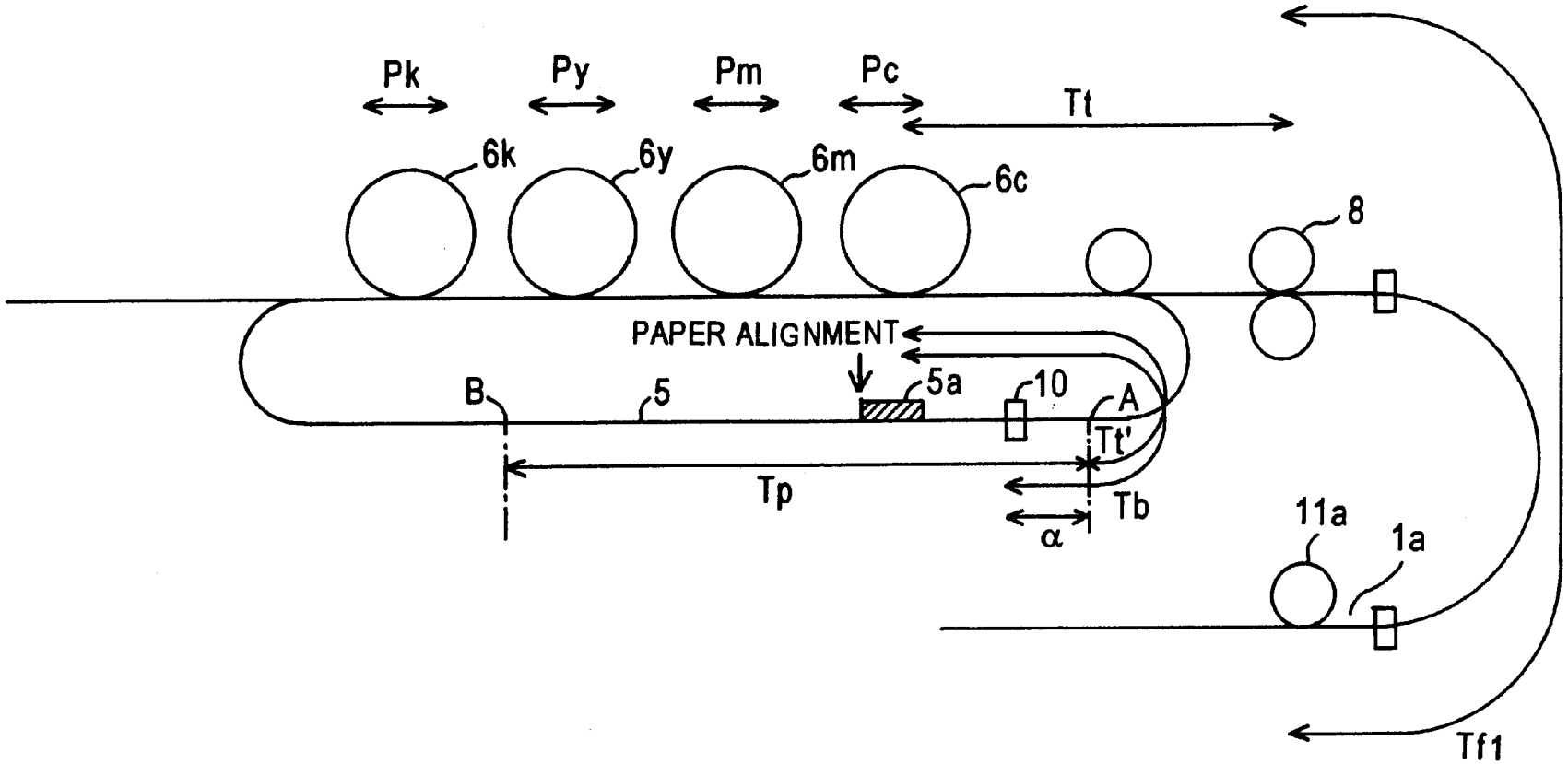
FIG. 4 is a schematic view of timing rollers, an image-transfer belt and therearound according to an embodiment of the present invention.
Figure 5:
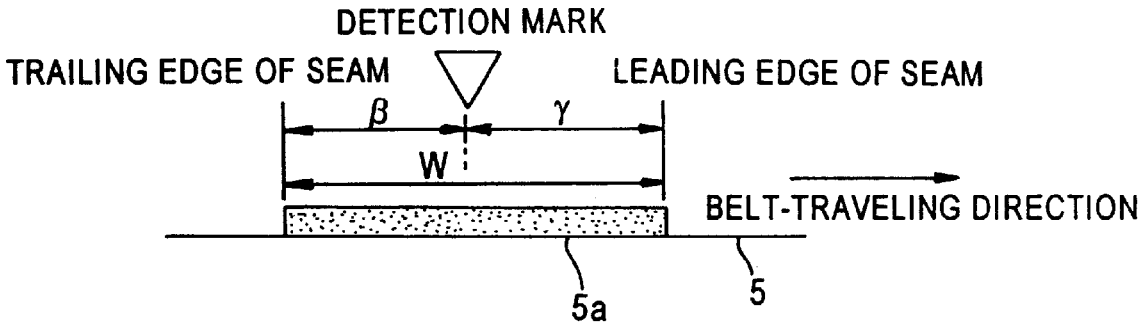
FIG. 5 is an explanatory view showing a seam portion of the belt according to an embodiment of the present invention.

FIG. 4 illustrates the structure around the timing rollers 8 and the belt 5. As shown in FIG. 4, a seam detection sensor 10 for detecting the seam 5*a* of the belt 5 is positioned on the upper stream of the photosensitive drum 6*c* along the traveling direction of the belt 5. When the seam detection sensor 10 detects the seam 5*a*, it generates an image-data request signal, which is supplied to the image processing circuit. If the time required for transporting the paper from the timing rollers 8 to the photosensitive drum 6*c*, which is located in the first image forming unit Pc, is Tt, and if the time from the generation of the image-data request signal to the actual start of paper-feeding by the timing rollers 8 plus extra time is $\alpha$, then the seam detection sensor 10 is placed at a position defined by time Tb which is sum of Tt' and a ($Tb=Tt'+\alpha$), where $Tt'=Tt$.

Accordingly, if time a has passed since the detection of the seam 5*a* by the seam detection sensor 10, (that is, if the seam 5*a* has reached point A shown in FIG. 4), the timing rollers 8 are driven to feed the paper onto the image-transfer belt 5, whereby the leading edge of the paper is aligned with the seam 5*a*. It should be assumed that the width of the seam 5*a* of the belt is infinitesimally small, and that the position of the seam 5*a* is coincident with the reference position for the leading edge of the paper.

If the time defined by (length of the paper)/(system speed) is Tp, and if the point at the upper stream from point A by time Tp is point B, then the paper-feed from the timing rollers 8 to the belt 5 is performed only when the seam 5*a* of the belt 5 does not exist in the section from B to A. Thus, point A corresponds to a time at which the leading edge of the paper aligns with the seam 5*a*, while point B corresponds to a time at which the trailing edge of the paper aligns with the seam 5*a*. If the paper is fed to the belt 5 with the seam 5*a* located in the section from point B to point A, the paper will be positioned on the seam 5*a*.

If the time elapsed from the detection of the seam 5*a* by the seam detection sensor 10 is T, T must satisfies formula (1) in order for the seam 5*a* not to exist in the section from point B to A (i.e., in order for the seam 5*a* to be located in the section from point A to B):

$$\alpha<T<Ts-Tp+\alpha \quad (1)$$

where Ts is the time required for one revolution of the belt 5, and the range of T is from 0 to Ts.

In actual process, the seam 5*a* has a certain width, and this width is converted to time W, which is defined as $W=\beta+\gamma$, where $\gamma$ represents time required for the paper to move from the detection mark to the leading edge of the seam 5*a*, and $\beta$ is time required for the paper to move from the trailing edge of the seam 5*a* to the detection mark. $\beta$ and $\gamma$ are determined so that the resultant image is not affected by the seam 5*a*.

Taking $\beta$ and $\gamma$ into account, inequality (1) becomes $$\alpha+\beta<T<Ts-(Tp+\gamma)+\alpha \quad (2)$$

which is further rewritten as $$0<T-(\alpha+\beta)<Ts-Tp-W \quad (3)$$

Figure 6:
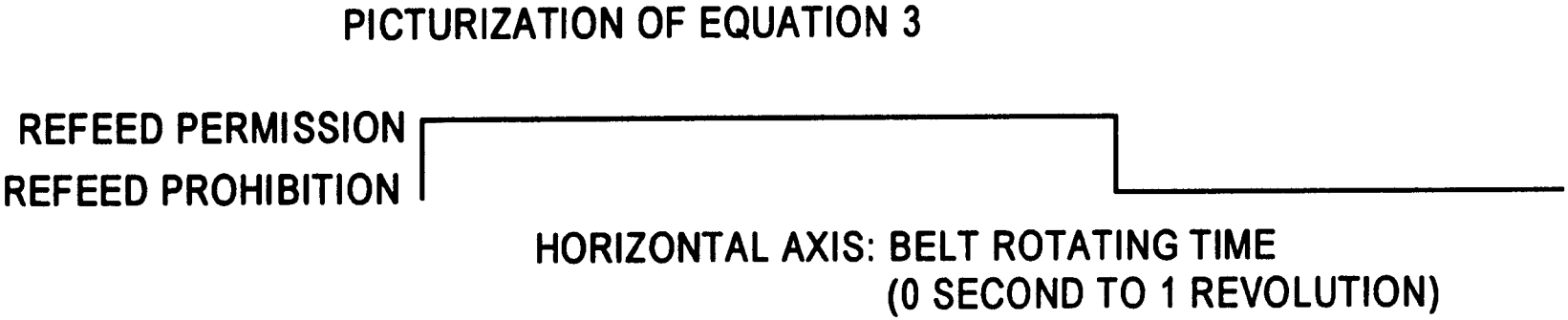
FIG. 6 is a graphical view showing the formula 3 according to an embodiment of the present invention.

If the paper is fed from the timing rollers 8 when T satisfies inequality (2) or (3), the paper does not overlap the seam 5*a*. Therefore, the paper-feed timing is controlled so that the paper is fed onto the belt 5 from the timing rollers 8 only when T satisfies inequality (2) or (3). Inequality (3) is picturized in FIG. 6.

The above is the basic explanation for the paper-feed control operation for avoiding the paper positioned on the seam 5*a* of the belt 5. However, in the actual operation, other factors should be considered.

In order to maintain the quick imaging efficiency, the position of the seam detection sensor 10 is determined so as to satisfy $$Tt+\alpha<Tb<Tf1$$

where Tf1 is time required from the initial paper supply to the formation of the loop. The image-transfer belt 5 is controlled such that the seam 5*a* is located at the position satisfy Ts−T<Tf1 when the belt 5 stops. Then, the belt 5 is driven again to feed the next paper immediately after the previous paper passed through the seam 5*a*. (That is, the belt 5 is driven again when Tf1−(Ts−T) has elapsed since the start of the paper feed.)

In order to achieve these control operations, the belt 5 should be driven at a constant speed for time T.

If the seam 5*a* of the belt 5 appears earlier than the expected time, due to, for example, delay in paper transportation or fluctuation in the belt stop position, then, it is preferable that the belt 5 is rotated one more revolution without feeding the next paper if in the fast imaging mode.

If the sorter has troubles in continuously ejecting papers due to, for example, a temperature change in image fixation, it is preferable that this information is added to the paper-feed timing control operation. In this case, the interval between papers positioned on the belt 5 is increased.

In general, the paper-transport speed can be changed according to the types of papers (e.g., ordinary paper, OHP, thick paper, etc.). It is also preferable to control and adjust the interval of papers according to the change in the paper-transport speed.

In order to avoid an image-memory phenomenon, in which a latent image formed on the photosensitive drum remains as an electrostatic image on the photosensitive drum and adversely affects the next image forming process, it is preferable to leave a space between papers by a distance corresponding to one revolution of the photosensitive drums 6*c*, 6*m*, 6*y*, and 6*k*. It is also preferable to set the paper ejection interval greater than a predetermined value when ejecting small-sized paper to the sorter. To prevent the image-memory phenomenon, a series of steps including charging, exposure, and erasing are performed over one revolution of the photosensitive drum.

Next, a paper-feed control for allowing a blank portion of the recording area is placed on the belt seam will be explained.

Figure 7:
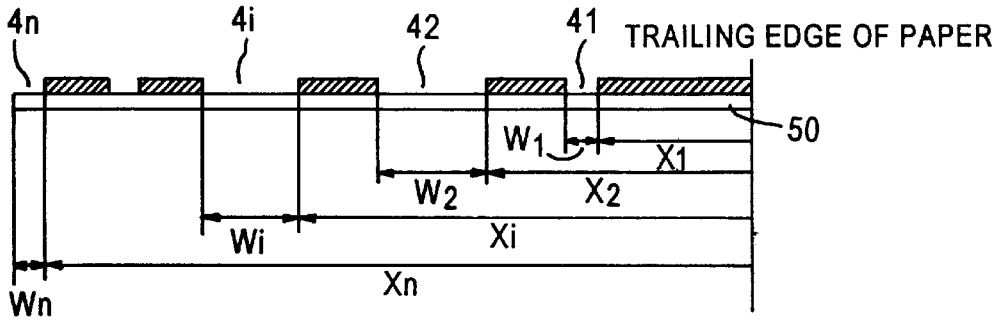
FIG. 7 is an explanatory view showing the relationship between a no-image forming unit (a blank area) and the trailing edge of the seam according to an embodiment of the present invention.
Figure 8:
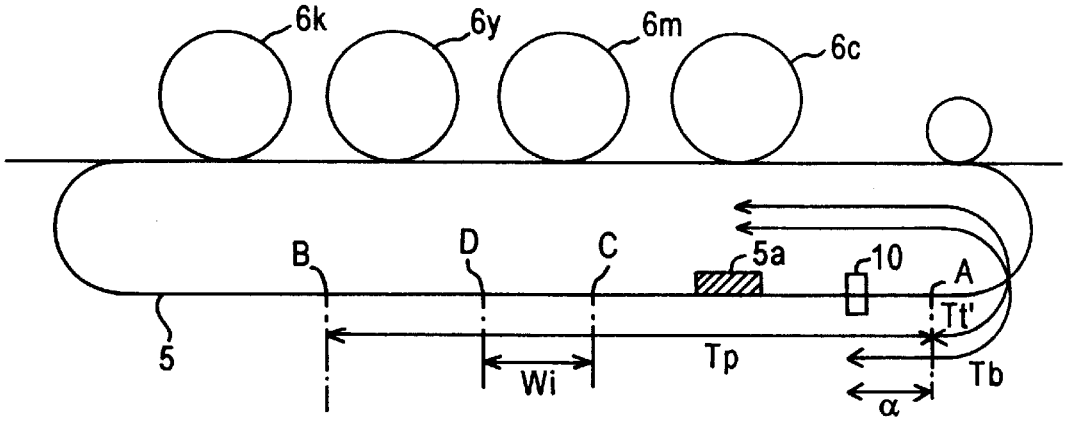
FIG. 8 is an enlarged explanatory view showing the timing rollers and the image-transfer belt according to an embodiment of the present invention.
Figure 9:
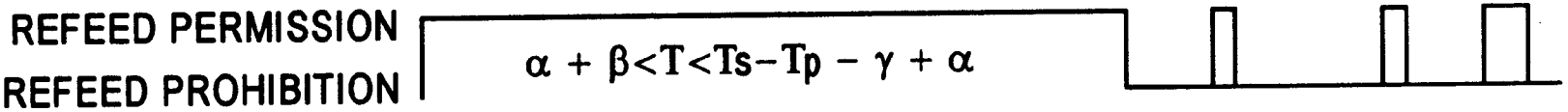
FIG. 9 is a graphical view showing the formula 4 according to an embodiment of the present invention.

FIG. 7 illustrates an example, in which there are multiple blank areas 41, 42, . . . , 4*n* in the recording area of a paper 50, each blank area extending in the direction perpendicular to the paper-feed direction across the recording area, and each having a width along the paper-feed direction greater than the width W of the seam 5*a* of the belt 5. The distance (or the system speed) from the trailing edge of the paper 50 to the starting point of each blank area is Xi (i=1, 2, . . . , n), and the width (or the system speed) of each blank area is Wi (i=1, 2, . . n).

When the paper 50 is fed, the leading edge (indicated by point C) and the trailing edge (indicated by point D) of an arbitrary blank area 4*i* lie between points A and B on the paper-feed path, which were explained above. If the paper 50 is fed from the timing rollers 8 to the transfer belt 5 when the seam 5*a* is positioned between points C and D, the blank area 4*i* will be placed on the seam 5*a*. Since no image is to be recorded in this blank area 4*i*, the total image quality is not affected by the seam 5*a*.

If time elapse from the detection of the seam 5*a* by the seam-detection sensor 10 is T, the paper-feed condition for feeding the paper 50 from the timing rollers 8 to the transfer belt 5 such that the seam 5*a* is positioned between points C and D is defined by inequality (4).

$$Ts-Tp+Xi<T-\alpha-\beta<Ts-Tp-W-Xi-Wi \quad (4)$$

where Xi and Wi are the blank start position and the width of the $i^{th}$ blank area, i=1, 2, . . n.

There are generally margins provided along the edge of paper 50. The paper 50 may be fed from the timing rollers 8 so that either margin is placed on a part or the entirety of the seam 5*a*. In this case the starting positions and the widths of the leading-edge margin and the trailing-edge margin are expressed by inequalities (5) and (6), by arranging Xi and Wi of inequality (4) which define the starting position and the width of the blank area, respectively.

Leading Edge Margin:

$$Ts-Xs<T-\alpha-\beta<Ts \quad (5)$$

Figure 10:
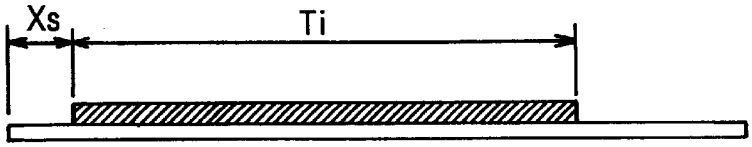
FIG. 10 is an explanatory view showing that blank areas are located at both ends of the recording sheet according to an embodiment of the present invention.

Trailing Edge Margin:

$$Ts-Tp-W<T-\alpha-\beta<Ts-W-Xs-Ts \quad (6)$$

where Xs is the image start position and Ti is the size of the recording area, as shown in FIG. 10. These inequalities are derived because the blank start positions and the widths of the leading and trailing edge are Xa and Wa, and Xe and We are expressed as Leading Edge Margin: Xa=Tp−Xs, Wa=W+Xs Trailing Edge Margin: Xe=−W, We=W+Tp−Xs−Ti By substituting these parameters for Xi and Wi in formula (4), inequalities (5) and (6) are obtained. Inequality (5) is applied to case in which the seam 5*a* has traveled round the belt path immediately before the seam 5*a* is detected, while the leading edge blank is approaching the seam 5*a*. For the first paper, T can not be defined unless the seam 5*a* is detected, inequality (5) can not be used before the seam 5*a* is detected. Therefore, inequality (5) is modified as $$0<T-\alpha-\beta+Xs<Xs \quad (7)$$

inequality (7) is only applied to the first paper. The paper-feed timing for the second and subsequent papers (i.e., Xs<T−α−β+Xs) is determined based on inequality (5). Alternatively, the first rotation of the belt 5 may be controlled so that the paper is placed immediately after the seam 5*a*, and the second and subsequent rotations are controlled based on formulas (3), (5), and (6).

Thus, if the total imaging area is relatively smaller than the paper size, and if there are several blank areas within the predetermined recording area, the paper-feed is controlled based on the timing for preventing the recording area from being positioned on the seam 5*a* (using formulas (5), (6) and (7)), and the timing for allowing the blank areas within the recording area to be positioned on the seam 5*a* (using formulas (3) and (4)).

Figure 11:
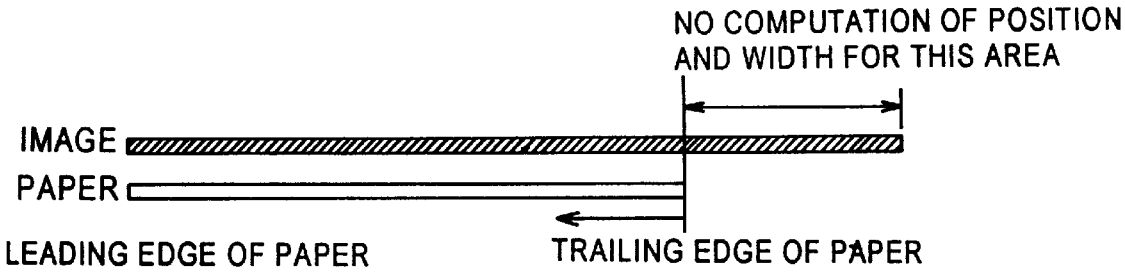
FIG. 11 is an explanatory view showing the image extending over the recording sheet.

If the total imaging area is larger than the paper size, and if there are several blank areas within the recording area, the paper-feed is controlled based on the timing for preventing the paper from being positioned on the seam 5*a* (using formula (3)), and the timing for allowing the blank areas to be positioned on the seam 5*a* (using formula (4)). In this case, the imaging area out of the paper is neglected, and no computation of the start position and width of the blank area is made, as shown in FIG. 11.

Inequalities (5), (6) and (7) are modifications of inequalities (3) and (4) and, therefore, the paper-feed timing is principally determined based on inequalities (3) and (4).

The blank areas are generally included in the original, which include intended blank spaces, spaces between characters, spaces between lines, and margins. However, several copy modes, such as leading edge/trailing edge erase, N in 1 center erase, ADF jam, magnification/reduction, also produce blanks. If the erase mode or the magnification/reduction mode is used, and blank areas which are not in the original are produced within the recording area, then such blank areas are detected and allowed to be positioned on the seam 5*a*.

Figure 12:
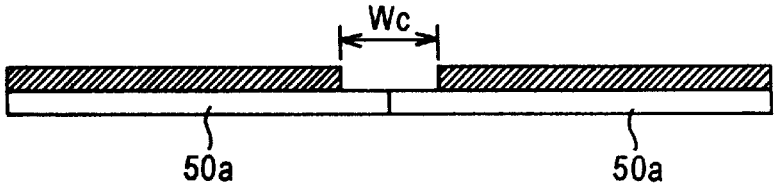
FIG. 12 is a relationship between the recording sheet and the blank area, by which an examination was carried out to confirm the effects of the present invention.

Next, an example in which two originals 50*a* of A4 size (based on the Japanese Industrial Standard) are photocopied in a A3 size paper using the center erase mode, as shown in FIG. 12, will be explained. In this example, two A4 papers are arranged side by side, both in the transverse direction of the transfer belt 5, and three sets of A4 pair are placed on the belt 5.

First, the images of two originals (i.e., A4 papers placed in the transverse direction) are taken in the memory. The parameters are set as follows:

paper size: A3 seam width W: 30 mm center blank: Wc (width of the center blank)>W (width of the seam)

Wc: 40 mm

X: 210−40/2=190 system velocity: 160 mm/sec length of the transfer belt: 930 mm paper-feed interval: 100 mm operation time for one routine of main routines: R1

Figure 13:
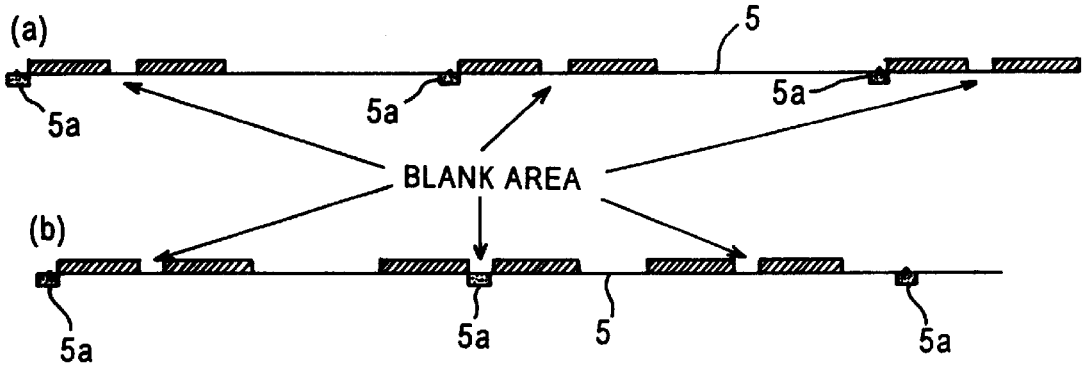
FIG. 13 is a relationship between a seam of the belt and a recording sheet, wherein FIG. 13 (*a*) shows the relationship when the recording sheet is fed in accordance with the conventional method, and wherein FIG. 13 (*b*) shows the relationship when the recording sheet is fed in accordance with the method according to an embodiment of the present invention.

First, a conventional method for controlling the seam position based only on the paper-size information, which is illustrated in FIG. 13(*a*), will be briefly described below for purposes of clarifying the feature of the present invention.

The value T−α−β is rewritten as T', where T is time elapse from detection of the mark of the seam 5*a* by the detection sensor 10.

When the first paper reaches the timing rollers 8, it is determined if the paper is allowed to be further fed to the transfer belt 5, based on inequality (3). If the paper-supply to the timing rollers 8 and the loop formation have been completed before a paper-feed permission is made (that is, if the paper is placed immediately after the seam 5*a* of the belt 5), inequality (3) becomes $$0<T'<(930-420-30)/160=3.0 \text{ sec} \quad (8)$$

Then, if the second paper reaches the timing rollers 8, the same determination as to whether or not the second paper can be further fed to the belt is made. At this point of time, T' is 520/160=3.25 sec. Because this value does not satisfy inequality (8), paper-feed of the second paper is only allowed after T' becomes 0, that is, after the next seam has just passed by. The same thing applies to the third paper.

Thus, the conventional method shown in FIG. 13(*a*) allows only a single A3 paper to be placed on the belt 5 during a rotation of the belt.

In contrast, the present invention controls the position of the seam 5*a* based on both the image information and the paper-size information.

In the method of the present invention, the first paper is supplied from a selected paper-supply port, reaches the timing rollers 8, and a loop is formed. Then, it is determined if the paper is allowed to be further fed to the transfer belt 5, based on inequalities (3) and (4). If the paper-supply to the timing roller 8 and the loop formation have been completed before a paper-feed permission is made (that is, if the paper is placed immediately after the seam 5*a* of the belt 5), inequality (3) becomes inequality (8), and inequality (4) becomes $$(960-420+190)/160 <T'<(960-420-30-190+40)/160$$

which is $$4.5625<T'<4.625 \quad (9)$$

Figure 14:
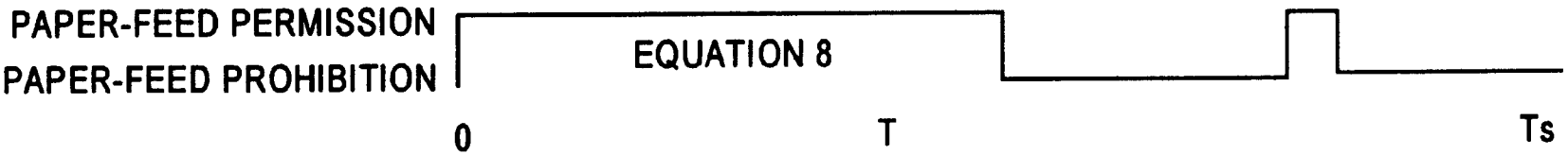
FIG. 14 is a graphical view showing the equation 8 and 9.

Inequalities (8) and (9) are illustrated as timing chart in FIG. 14.

In FIG. 14, if the period for satisfying inequality (8) is finished, another period for satisfying inequality (9) is set after a certain time interval. When the first paper was supplied to the transfer belt 5, and the second paper has reached the timing rollers 8 with a loop formed, the period for satisfying inequality (8) has been finished. Then, if time T' has elapsed and inequality (9) is satisfied, the second paper is fed to the transfer belt. Under this timing control, the center blank between two papers is to be placed on the seam 5*a*.

When the third paper reaches the timing rollers 8, the period for satisfying inequality (9) is finished, the transfer belt 5 has traveled round the full rotation path, and T' is newly detected. The third paper is fed to the belt 5 when time T' has elapsed and period for satisfying inequality (8) has come. This operation is illustrated in FIG. 13(*b*).

As is clear from comparison between FIG. 13(*a*) and 13(*b*), the center blank between two paper is efficiently utilized in the present invention, which allows the imaging process to be completed half round earlier than the conventional method. Consequently, the productivity increased. This effect becomes conspicuous as the number of pairs of paper placed on the belt 5 increases. Because the paper-feed is controlled so that the center blank is placed on the seam 5*a*, the final image quality is not affected by the seam 5*a*.

Figure 15:
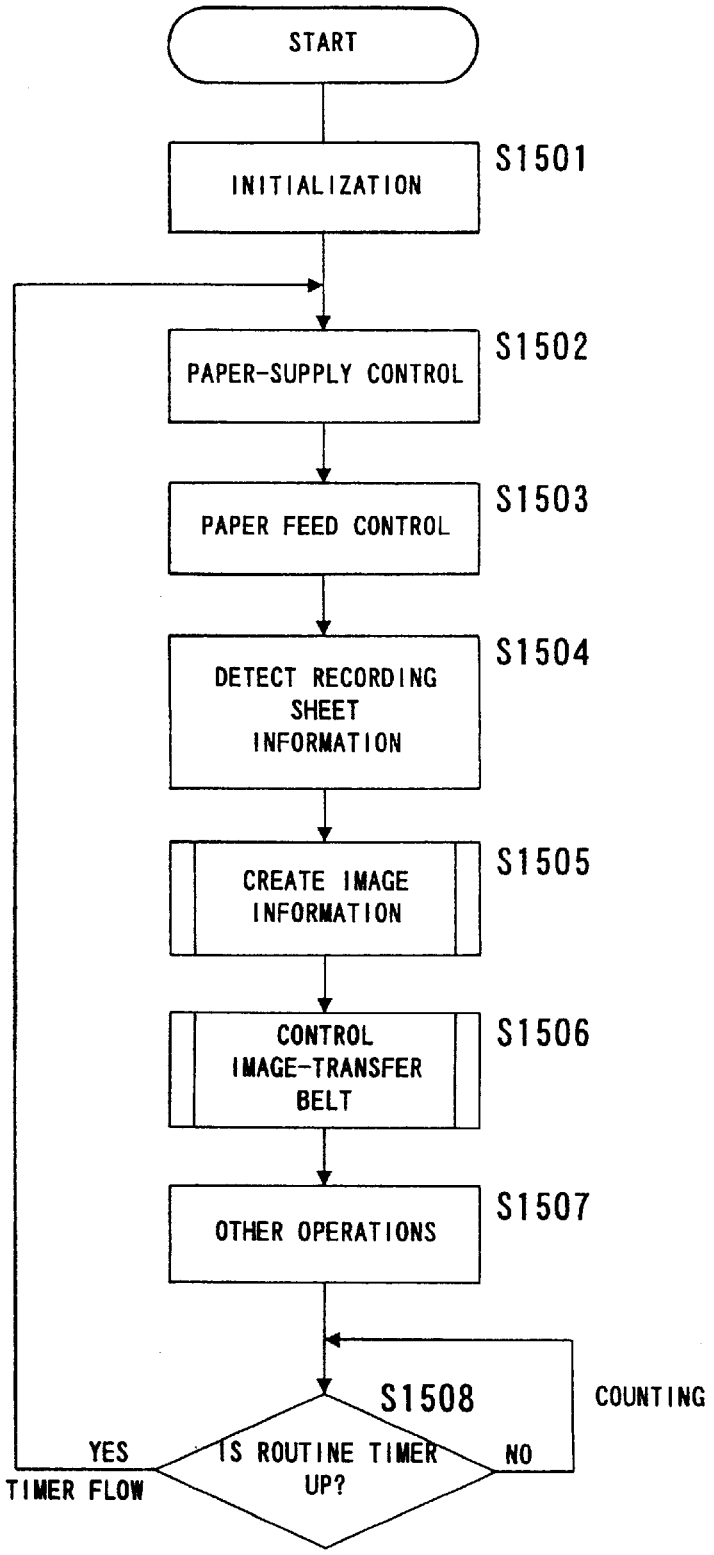
FIG. 15 is a flowchart showing a main routine process according to an embodiment of the present invention.

FIG. 15 is a flowchart showing the control operations performed by the main body controller 306.

When the power is turned on, and the CPU of the main body controller 306 is activated, prescribed initialization, which includes initialization of the CPU, the memory, and the I/O, is performed in Step S1501. At this time, the values of α, β, γ, and Ts are also set.

In Step S1502, a paper is supplied from a paper-supply port selected among the ports 1*a* through 1*d*, in response to a request for paper supply.

Then, the paper-feed action for correctly feeding the paper to the transfer belt is controlled in Step S1503. First, the paper supplied from one of the paper-supply ports 1*a*–1*d* is paused at the timing rollers 8 for skew correction and paper-feed timing. If the paper-feed flag indicates a permission, the paper is fed by the timing rollers 8 to the transfer belt 5.

In Step S1504, information about the recording medium is detected. For example, if the selected paper-supply port is a cassette, the length of the paper along the paper-feed direction is detected from the position of the partition set in the cassette. The recording medium information can be set directly by a user.

For example, a user can set the paper size stored in the cassette through the operation panel shown in FIG. 2. The liquid crystal display for inputting a desired paper size is opened by pressing the keys on the operation panel in a prescribed order (e.g., by pressing the copy interruption key 203 twice, and then, the cassette selection key 208 twice). When the input display is opened, a desired cassette is selected through the cassette selection key 208, and the vertical and horizontal sizes of the paper are input through the ten-key of the page number setting unit 201. In order to confirm the input data, the print key 202 is pressed. In order to quit the input display, the reset key of the page number setting unit 201 is pressed.

In Step S1505, image information is created. The details of this operation will be described below.

Then, the driving operation of the transfer belt 5 is controlled in Step S1506. At the same time, the position of the seam 5*a* is detected, and necessary information is created. Such necessary information includes information about permission and prohibition of the rotation of the timing rollers 8, the paper sizes in the cassettes, the original size, and other information. The details of this step will also be described below.

In Step S1507, other operations, such as communication with other CPUs, detection of abnormal operations, input/output from the I/O port, image processing, etc., all of which are not directly related to the paper-supply control and the paper-feed control of the present invention, are performed.

In Step S1508, the routine timer is checked if the time is up. The routine timer counts every predetermined time set for performing the operation flow from the paper-supply (Step S1502) to the other operations (Step S1507). Every time the routine timer flows, one cycle of operation flow is performed.

Now, the creation of image information (Step S1505) will be explained in more detail. Image information is created from the image data which was read by the CCDs and stored in the image memory. There are several ways to change the magnification of the photocopy (i.e., to change the size of the image recorded on a paper from the original size). One method is to adjust the scan speed and the lens position are adjusted when the image is captured by the CCDs, and the image data with changed size is stored in the image memory. Another method is to store the image data of the original size in the image memory, and to perform some image processing to change the size. Still other method is to change the size when writing the image on the photosensitive drum. Similarly, there are several ways to erase. The erasing operation may be performed during the capturing the image data by the CCDs, or during the writing of the image data on the drum, or alternatively, the image data with the original size stored in the memory can be processed for erasing. In this embodiment, the image data is captured from the original, and is stored in the image memory. Then, the stored data is subjected to some image processing, such as enlargement, reduction, or erase. The processed data is again stored in the image memory, and image information is created based on this processed data.

Figures 16, 17:
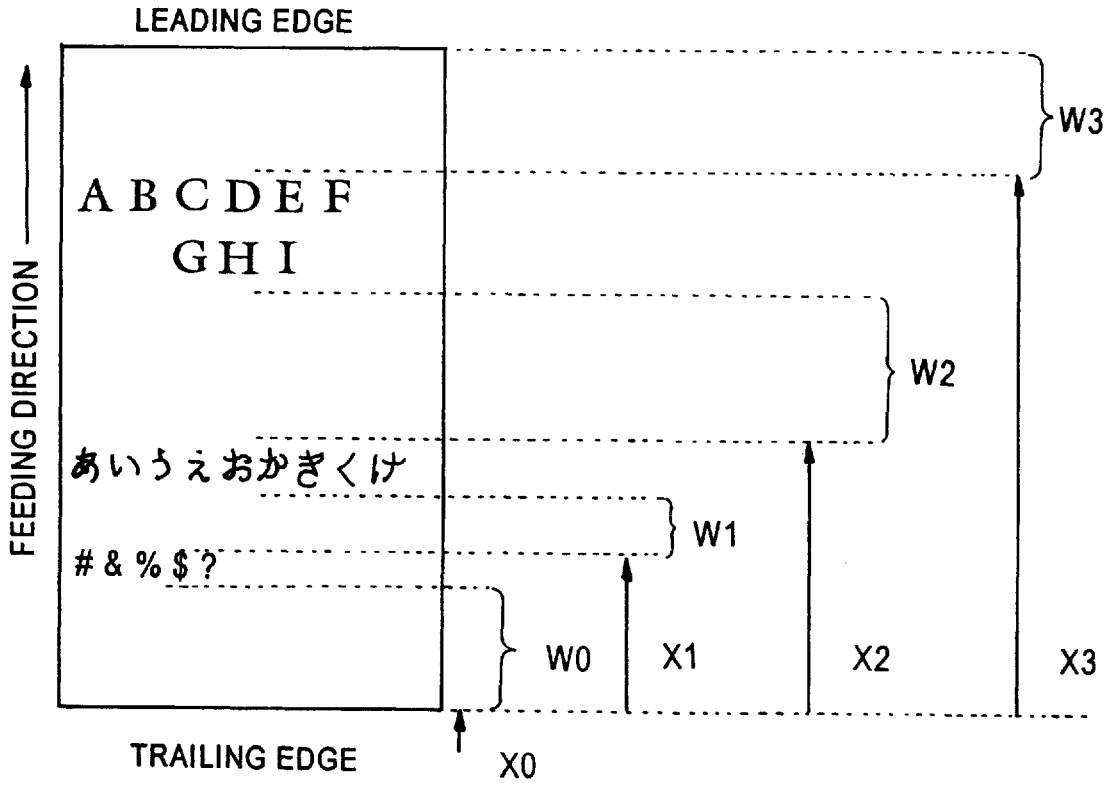
FIG. 16 is an example of image data.
FIG. 17 is an explanatory view showing a document image information.

Image information is created in order to control the positional arrangement of the image areas and non-image areas (i.e., the blank areas) for each original so that the original arrangement is correctly reproduced in the resultant image. For example, the original has the image shown in FIG. 16. W0 through W3 are blank areas, and the rest of the portions are image areas. XO through X3 are the distances from the trailing edge of the paper to the blank areas WO through W3. If there is no image on the trailing edge of the paper, XO become zero (XO=0). The original image information created for this example is shown in FIG. 17.

Since the number of image areas and the number of blank areas differ among the originals, "valid/invalid" in the left column indicates if each area stores the data (or if each area can be referred to). If an area stores data, the area is labeled as "valid".

If the image size differs from the paper size, the leading edge and the trailing edge of the image can be determined arbitrarily if the orientation of the image ejected from the ejection tray is not taken into account. In this example, the leading edge and the trailing edge are set as shown in FIG. 16.

Figure 18:
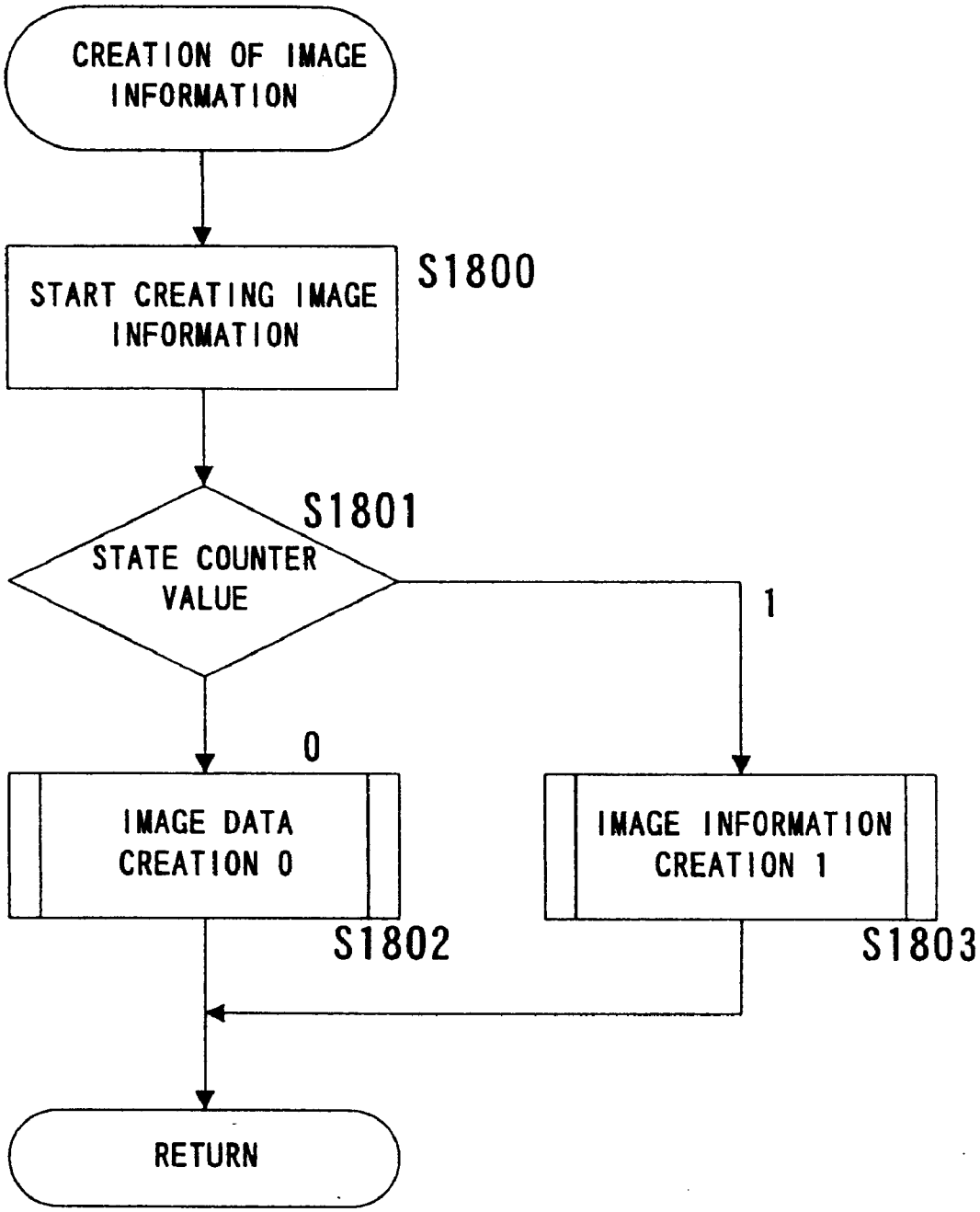
FIG. 18 is a flowchart showing an image information process according to an embodiment of the present invention.

FIG. 18 is a flowchart of the creation of image information.

This process consists of state operations, and necessary operations are performed according to the value of the state counters (Step S1801).

The state counter is initialized to 0. If the creation of image information is started in Step S1800, a request for creating image information is set.

Figure 19:
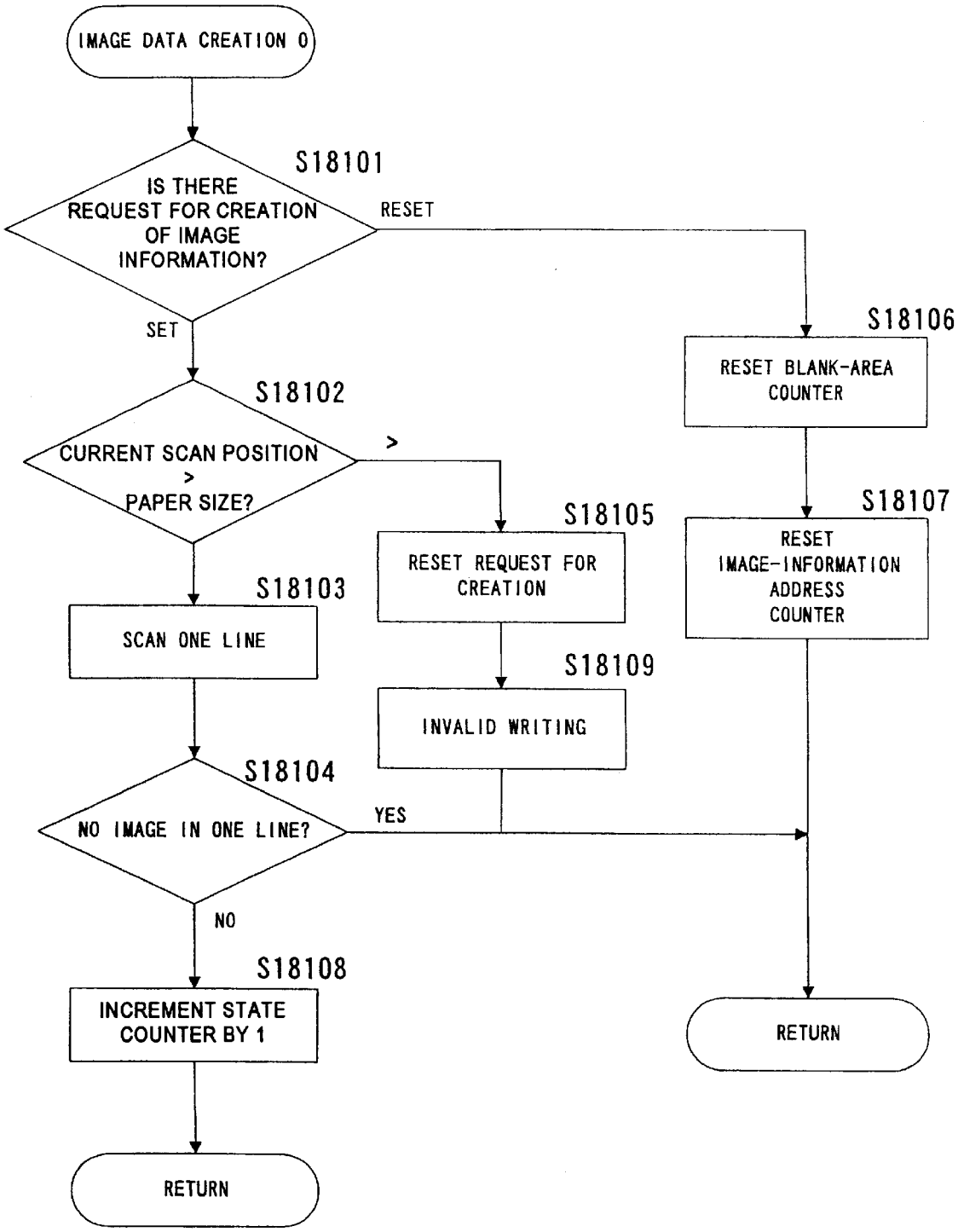
FIG. 19 is a flowchart showing a detail image information process 0 in the image information process in FIG. 18.

FIG. 19 is a flowchart showing the details of the image information creation 0 (Step S1802) shown in FIG. 18.

It is determined if a request for creating image information is set in Step S18101. If the request is set, the current scan position is compared with the paper size (Step S18102). If the current scan position is greater than paper size, the request for creating image information is reset in Step S18105, and the valid/invalid flag of the address indicated by the image information address is set to valid in Step S18109. If the current scan position is not greater than the paper size in the determination of Step S18102, the process proceeds to Step S18103, in which one line of image data is scanned. In Step S18104, it is determined if there is an image in the scanned line. If there is an image, process returns to FIG. 18. If there is no image in the scanned line, the state counter is incremented by 1 in Step S18108.

If, in Step S18101, the request for creating image information is reset, the process jumps to Step S18106, in which the blank-area counter is reset, and then the image-information address counter is reset in Step S18107.

Figure 20:
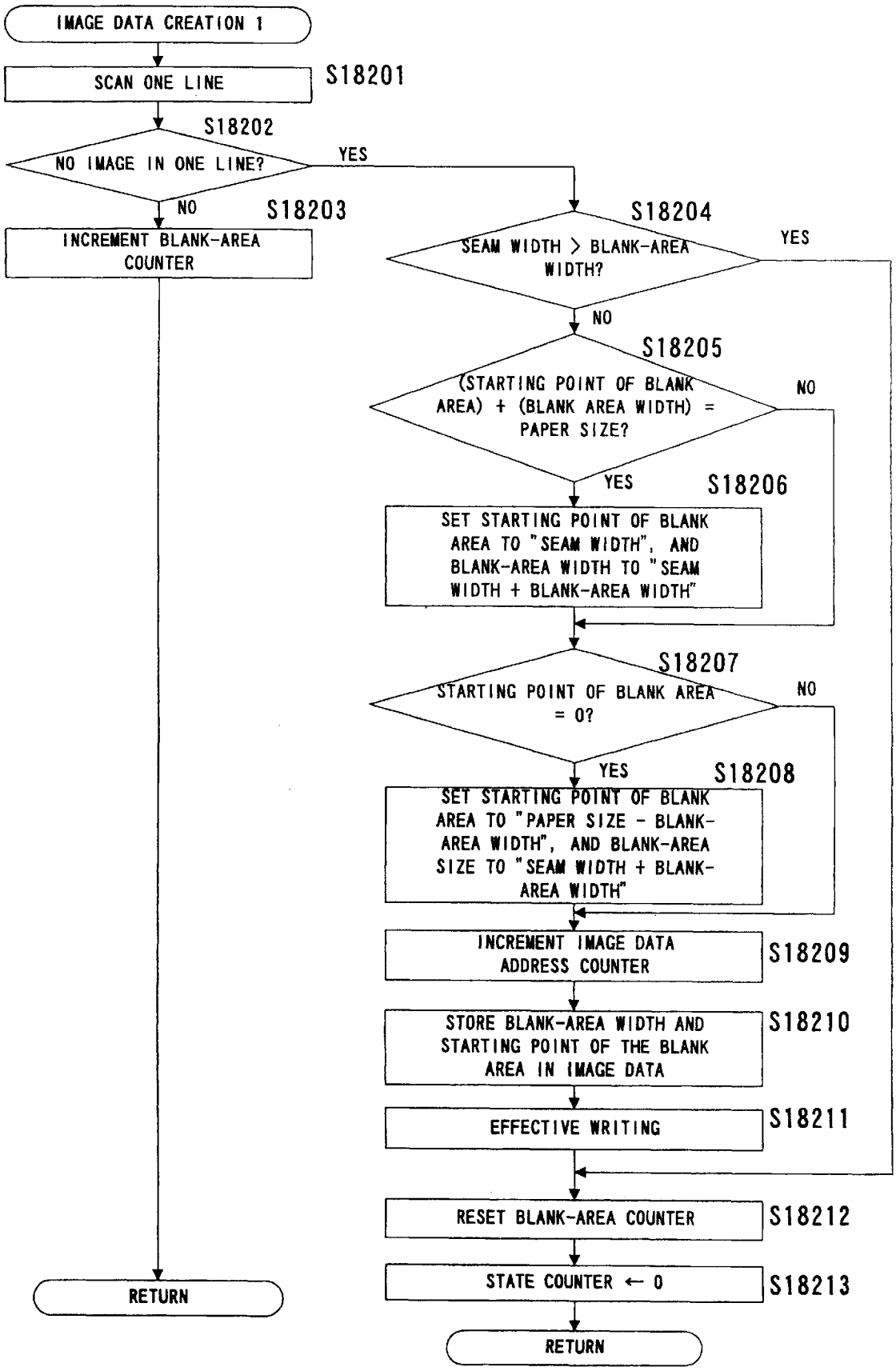
FIG. 20 is a flowchart showing a detail image information process 1 in the image information process in FIG. 18.

FIG. 20 is a flowchart showing the details of the image information creation 1 (Step S1803) shown in FIG. 18.

In Step S18201, one line of image data is scanned, and it is determined if there is an image in that line in Step S18202. If there is no image (NO in determination in Step S18202), the blank-area counter is incremented by 1 in Step S18203. If there is an image (YES in Step S18202), the width of the blank-area is defined, and the defined width is compared with the width of the seam 5*a* in Step S18204. If the width of the seam 5*a* is Ws(mm), the resolution is 400 dpi, then the line number corresponding to the width of the seam 5*a* is Ws/25.4×400. If the value of the blank-area counter, which represents the width of the blank area, is smaller than the line number for the seam 5*a*, the process jumps to Step S18212, in which the blank-area counter is reset in Step S18212, and the state counter is reset to 0 in Step S18213. If the width of the blank area is not smaller than the seam width in Step S18204, a series of operations from Step S18205 through 18211 is performed.

In Step S18205, it is determined if the sum of the width of the blank area and the starting position of the blank area equals the paper size. If YES, the starting point of the blank area is set to "seam width", and the width of the blank area is set to "Ws+blank-area width" in Step S18206. If NO in the determination of Step S18205, the process jumps to Step S18207, in which it is determined if the starting position of the blank area is zero. If YES in this determination, the starting position of the blank area is set to "(paper size)–(blank-area width)", and the width of the blank area is set to "Ws+blank-area width" in Step S18208. If NO in the determination of Step S18207, the process jumps to Step S18209, in which the image-information address counter is incremented. The starting position and the width of the blank area are stored in the address indicated by the image-information address counter in Step S18210, and the valid/invalid flag is set to "valid" in Step S18211.

Figure 21:
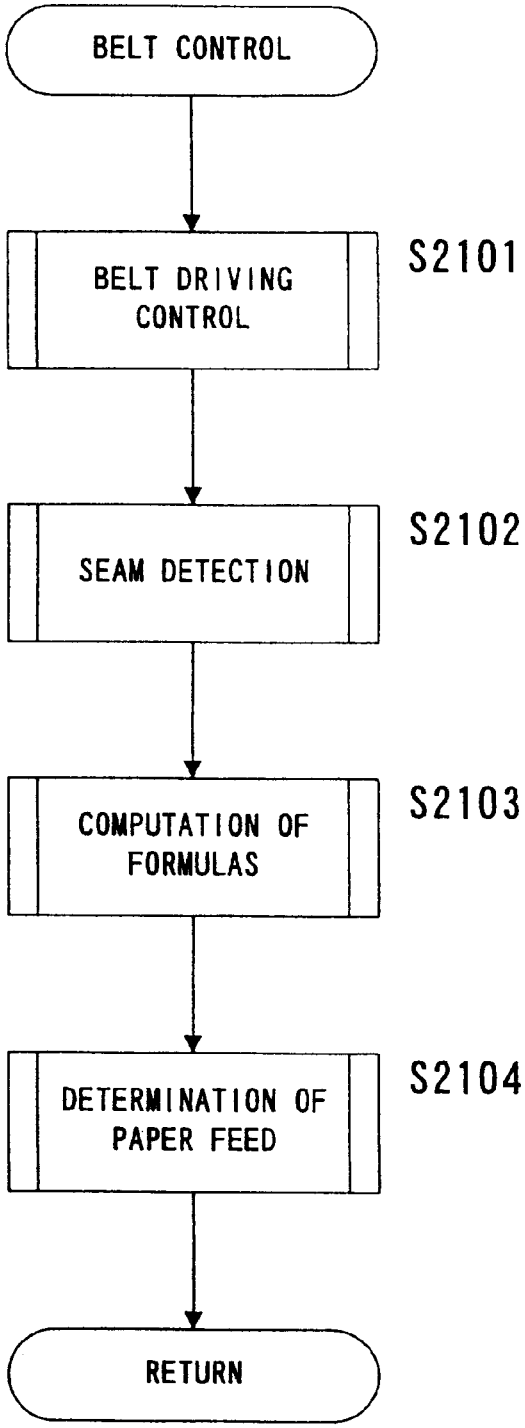
FIG. 21 is a flowchart showing an image-transfer belt control process according to an embodiment of the present invention.

FIG. 21 is a flowchart of the belt control (Step S1506) shown in FIG. 15.

Figure 22:
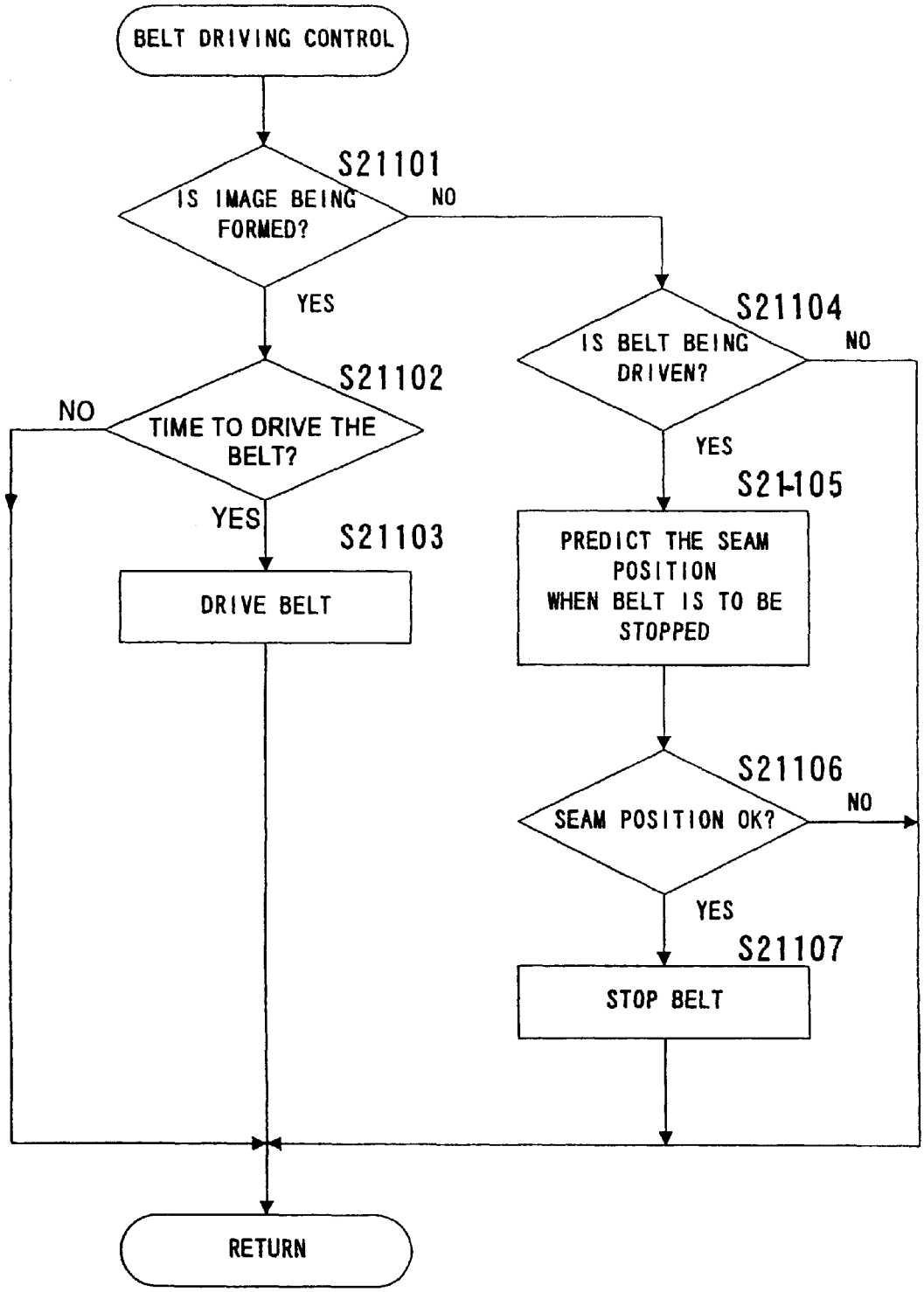
FIG. 22 is a flowchart showing an image-transfer belt driving control process according to an embodiment of the present invention.

First, the driving of the image-transfer belt is controlled in Step S2101, the details of which is shown in the flowchart of FIG. 22. In Step S21101, it is determined if an image is being formed on a paper (i.e., under the photocopying process). If the image is being formed, it is determined if it is time to drive the transfer belt 5 in Step S21102. The appropriate time to drive the transfer belt 5 is that if the driving of the transfer belt 5 is started at that time, the leading edge of the first paper will be positioned immediately after the seam 5*a*. Accordingly, it is always regarded for the second and subsequent papers that it is time to drive the belt 5, and the belt 5 is driven in Step S21103. If no image is being formed (that is, NO in the determination) in Step S21101, the process proceeds to Step S21104, in which it is determined if the transfer belt 5 is being driven. If YES in Step S21104, it is regarded that time has come to terminate the imaging process, and the transfer belt 5 is stopped so that the seam 5*a* is positioned at a predetermined position which allows the next imaging process to be started in a minimum time (Step S21105 through Step S21107).

If the adsorption point, at which the leading edge of the paper is adsorbed to the belt 5, is Q, and if the distance from Q to the leading edge of the paper stored in the cassette is Lp, and the distance from Q to the seam 5*a* is Ls, the transfer belt 5 is stopped at a position satisfying Lp>Ls. By delaying the driving of the transfer belt 5 with respect to the paper-feed operation by a time corresponding to the difference between Lp and Ls when the next imaging operation is commenced, the leading edge of the next paper can be placed immediately after the seam 5*a* without stopping the paper (for waiting the passage of the seam 5*a*) at the timing rollers 8. The value of Lp is determined based on the first cassette so that the relation Lp>Ls is satisfied no matter which cassette is selected.

Figure 23:
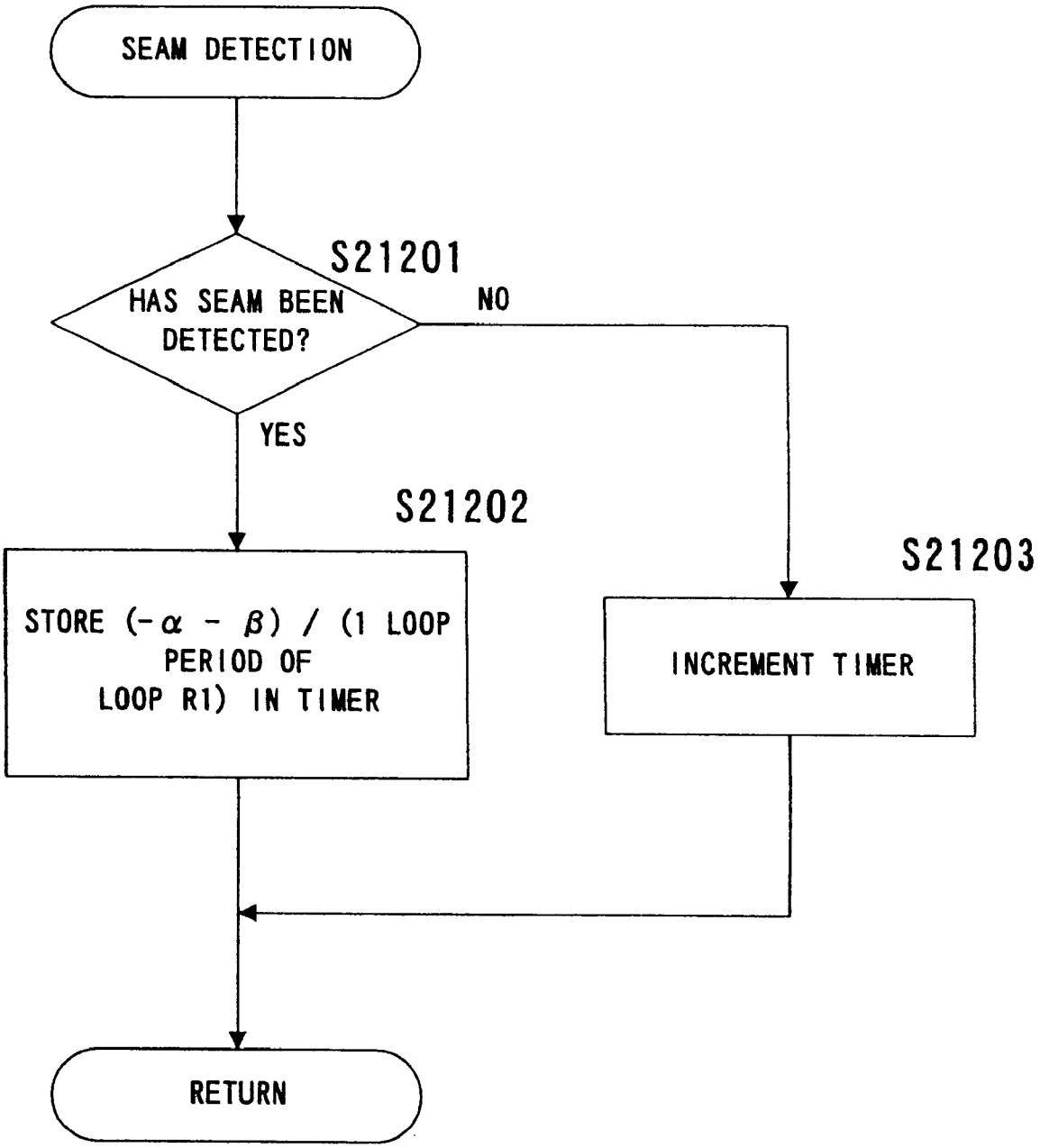
FIG. 23 is a flowchart showing a seam detect process according to an embodiment of the present invention.

Returning to FIG. 21, in the seam detection operation in Step S2102, the seam 5*a* of the transfer belt 5 is detected, and time elapse from the detection is counted. FIG. 23 shows the detailed steps of this process in a flowchart.

First, in Step S21201, the seam 5*a* is detected by a detection sensor 10 which is, for example, a combination of an LED and a phototransistor. If the seam 5*a* is detected (YES in Step S21201), the value of $(-\alpha-\beta)$/(time of 1 loop of the main routine) is stored in the timer for counting the time elapse from the detection of the seam 5*a* (Step S21202). If no seam 5*a* is detected, the timer is incremented (Step S21203).

Figure 24:
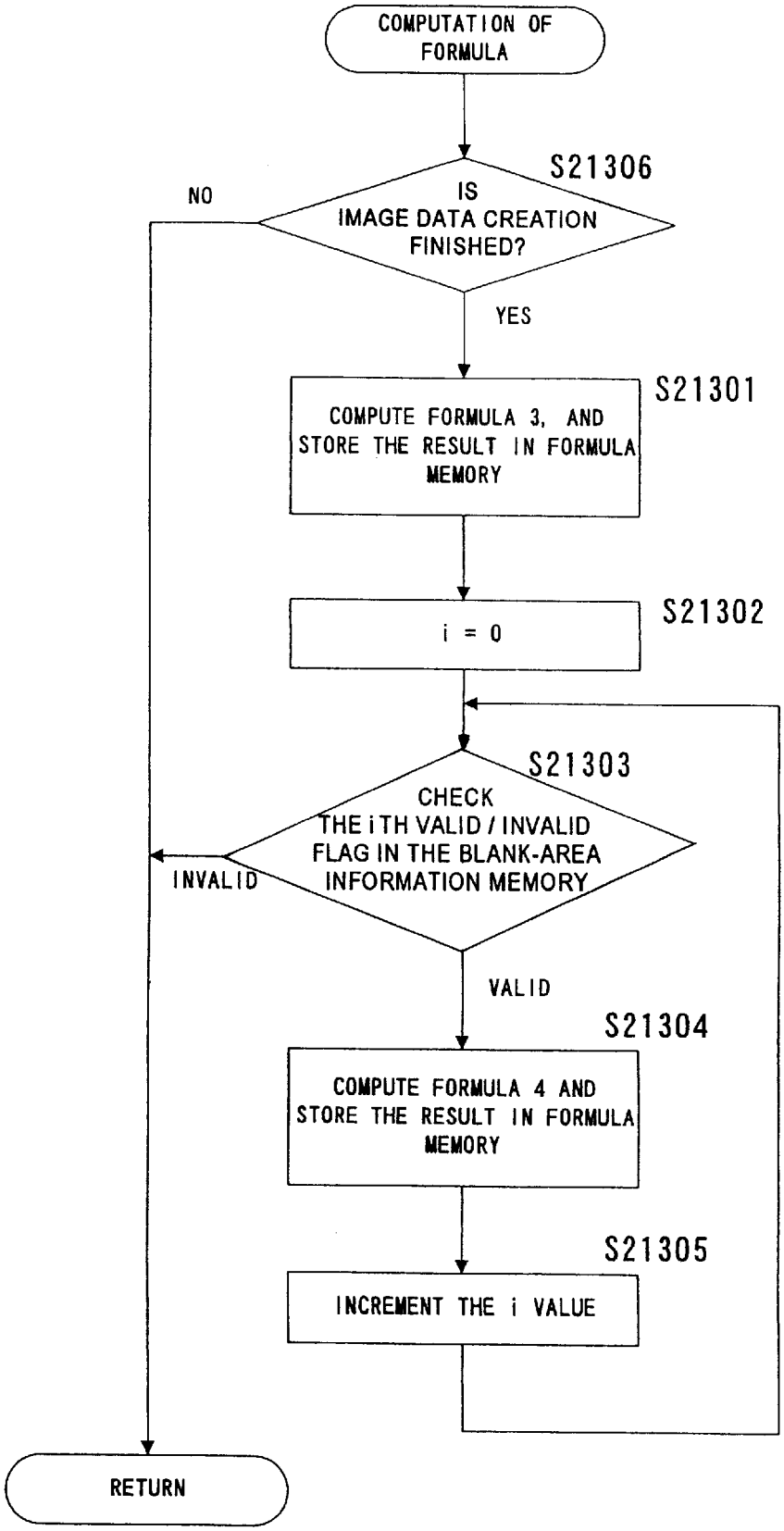
FIG. 24 is a flowchart showing a formula calculating process according to an embodiment of the present invention.

In the computation of formulas in Step S2103 shown in FIG. 21, formulas (3) and (4) are calculated. FIG. 24 shows the detailed steps of this operation in a flowchart. In Step S21306, it is determined if the creation of image information is finished. If it has not been finished yet (NO in the determination), no action is taken, and the process returns. If the creation of image information has been finished, the process proceeds to Step S21301. In Step S21301, the values of $\alpha$, $\gamma$, $\beta$, and Ts are read from the setting information, Tp is read from the paper information, and formula (3) is calculated based on these values. The calculated value is stored as formula information memory. Formula (4) is calculated in Step S21302 through Step S21305. In Step S21302, the address counter i is reset to 0. Then, it is determined if the valid/invalid flag for the formula information indicated by the address counter i is valid in Step S21303. If the flag is valid, formula (4) is calculated based on the data contained in the formula information indicated by the address counter i, and the calculated value is stored in the formula information memory (Step S21304). Then, the address counter is incremented (Step S21305), the process returns to Step S21303. If the valid/invalid flag is invalid, no action is taken.

Figure 25:
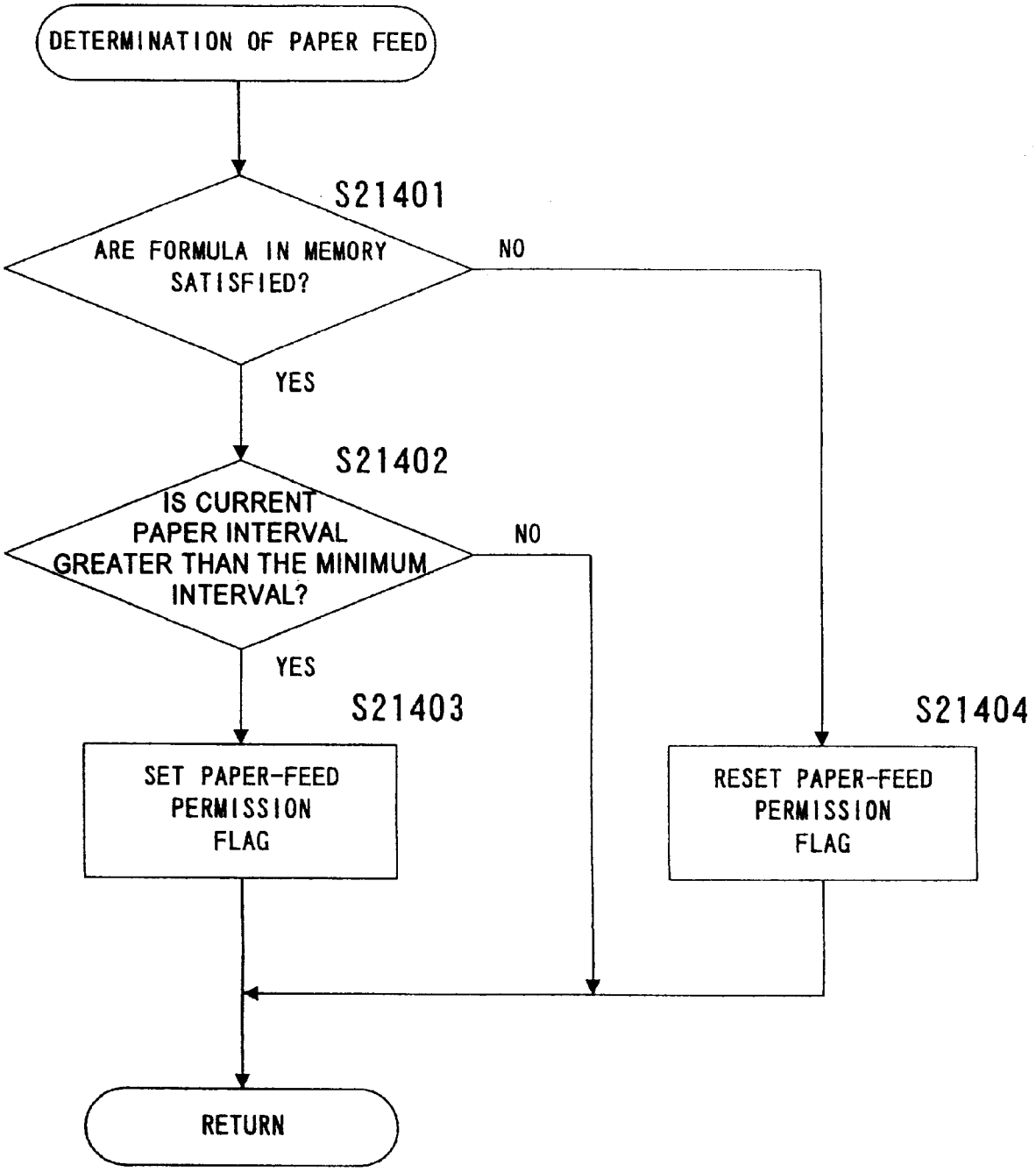
FIG. 25 is a flowchart showing a paper feed determination process according to the present invention.
Figure 26:
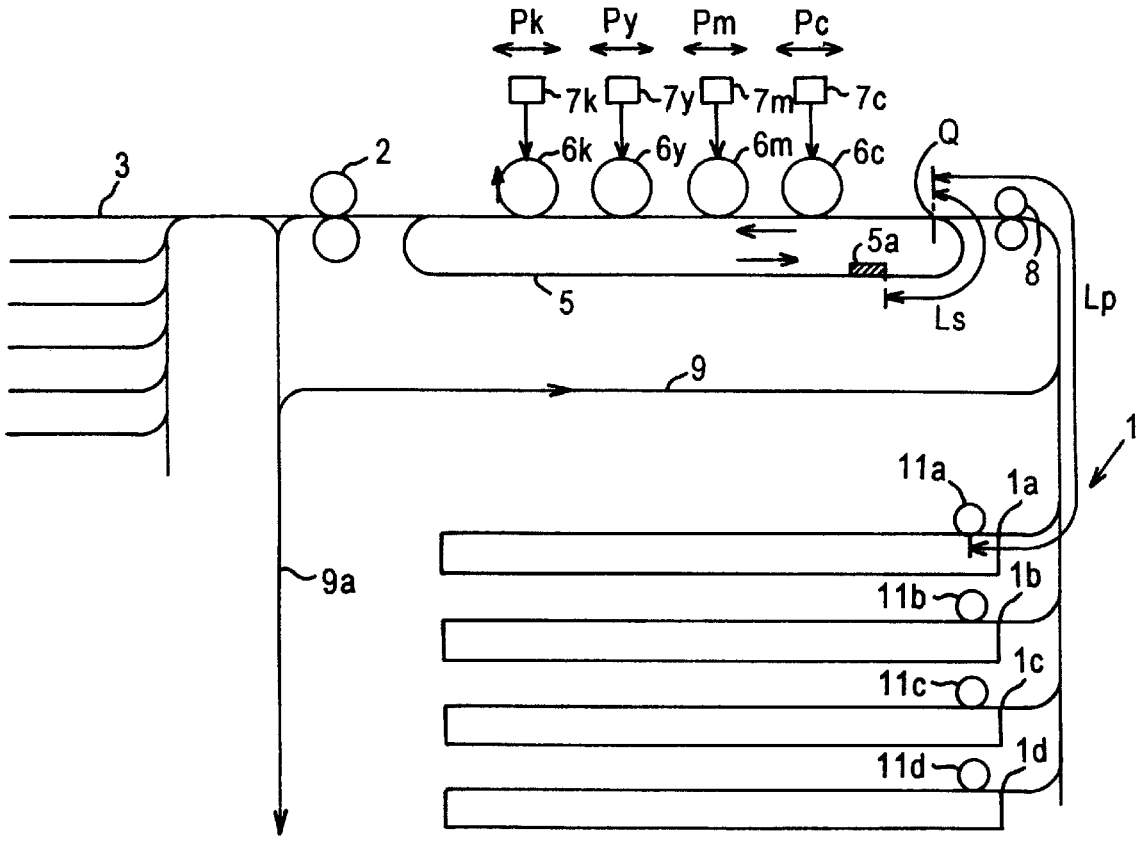
FIG. 26 illustrates the distance Lp from the absorbing point Q on the transfer belt and the leading edge of the paper stored in the cassette type tray, and the distance Ls from the point Q to the seam position in the image forming apparatus of FIG. 1.

In the determination of paper feed operation in Step S2104 shown in FIG. 21, it is determined if the paper is allowed to be fed to the transfer belt 5. The paper-feed permission flag is set or reset according to the determination result. FIG. 25 shows the detailed steps of this process.

First, in Step S21401, it is determined if the 1-loop time (defined by (timer)×(loop R1)) satisfies the data (formulas (3) and (4)) stored in the formula information memory in Step S21401. If the formulas are not satisfied (NO in the determination), the paper-feed permission flag is reset in Step S21404. If the formulas are satisfied (YES in the determination of Step S21401), then it is determined if the distance between the current paper and the previous paper is greater than the predetermined minimum paper interval in Step S21402. If YES, the paper-feed permission flag is set in Step S21403. If NO in the determination of Step S21402, no action is taken. For the first paper, this determination is not performed, or it is automatically determined that the paper interval is greater than the predetermined minimum value. Thus, the paper-feed flag is used to determine if the paper may be fed to the transfer belt during the paper-feed operation.

Although, in the embodiment described above, the undesirable area on the belt which adversely affects the image quality is the seam 5*a*, some other factors may exist. The present invention can be equally applied to such undesirable cases.

This application claims priority to Japanese Patent Application No. H9(1997)-321793 filed on Nov. 21, 1997, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An image forming apparatus, comprising:

a recording sheet transporting member which has a specific portion and transports a recording sheet while holding the recording sheet thereon, said recording sheet transporting member being endless;

a recording sheet feeding member which feeds the recording sheet to said recording sheet transporting member;

judge means which judges whether or not an overlap-permissible region, which is permitted to overlap said specific portion, is to be formed on the recording sheet, said overlap-permissible region being a blank portion within a recording area;

a controller which controls, based on a judged result of said judge means, a feeding of the recording sheet to said recording sheet transporting member so that said overlap-permissible region overlaps said specific portion, or so that the recording sheet does not overlap said specific portion.

2. The image forming apparatus as recited in claim 1, wherein the overlap-permissible region extends over an entire width of the recording sheet perpendicular to a traveling direction thereof and having a predetermined length along the traveling direction.

3. The image forming apparatus as recited in claim 2, wherein the overlap-permissible region is to be located between two colored images to be formed on the recording sheet.

4. The image forming apparatus as recited in claim 2, wherein the overlap-permissible region is to be located at an end portion of the recording sheet in the traveling direction of the recording sheet.

5. The image forming apparatus as recited in claim 1, wherein the overlap-permissible region is detected based on image information.

6. The image forming apparatus as recited in claim 5, wherein said image information relates to whether or not at least one blank region extending over an entire width of the recording sheet perpendicular to a traveling direction thereof and having a predetermined length along the traveling direction is to be formed on the recording sheet.

7. The image forming apparatus as recited in claim 5, wherein said image information relates to an image size.

8. The image forming apparatus as recited in claim 1, wherein the overlap-permissible region is detected based on image information and recording sheet information.

9. The image forming apparatus as recited in claim 8, wherein said image information relates to whether or not at least one blank region extending over an entire width of the recording sheet perpendicular to a traveling direction thereof and having a certain length along the traveling direction is to be formed on the recording sheet.

10. The image forming apparatus as recited in claim 6, wherein the image information relates to an image size.

11. The image forming apparatus as recited in claim 6, wherein the recording sheet information relates to a size of the recording sheet.

12. The image forming apparatus as recited in claim 1, further comprising:

an image information detector which detects image information;

a recording sheet information detector which detects information on the recording sheet; and a detector which detects said specific portion, wherein said controller decides a timing for feeding the recording sheet based on a detected result of said image information detector, said recording sheet information detector and said detector.

13. The image forming apparatus as recited in claim 1, wherein said specific portion is a seam.

14. An image forming apparatus, comprising:

an image holding member on which an image is formed; a recording sheet transporting member which transports a recording sheet onto which an image formed on said image holding member is transferred, to a transferring position while holding the recording sheet thereon, said recording sheet transporting member being endless and having a seam;

a seam detector which detects said seam;

a recording sheet information detector which detects recording sheet information; an image information detector which detects image information on whether or not an overlap-permissible region, which is permitted to overlap said seam, is to be formed on the recording sheet, said overlap-permissible region being a blank portion within a recording area: and an image-transfer member which transfers an image on said image holding member to the recording sheet at the transferring position;

wherein the recording sheet is fed to said recording sheet transporting member at predetermined intervals, and wherein a timing for feeding the recording sheet to said recording sheet transporting member is determined based on a detected signal from said image information detector, said recording sheet information detector and said seam detector.

15. The image forming apparatus as recited in claim 14, wherein said image information detector detects one or more blank portions extending over an entire width of the recording sheet perpendicular to a traveling direction thereof and having a certain length along the traveling direction, or said one or more blank portions and an image size, wherein said recording sheet information detector detects a size of the recording sheet, and wherein the timing for feeding the recording sheet to said recording sheet transporting member is determined so that the seam is located at said blank portion or between a plurality of recording sheets.

16. An image forming apparatus, comprising:

a feeding member which feeds a recording sheet placed on a sheet tray;

a transporting member which receives the recording sheet from said feeding member and transports the recording sheet while holding the recording sheet thereon, said transporting member having an inappropriate portion;

an image forming unit which forms, based on image data, an image including at least one colored portion on the recording sheet held on said transporting member, wherein said image forming unit cannot previously form the at least one colored portion of the image on a portion of the recording sheet which is located on said inappropriate portion;

judging means for judging, based on the image data, a specific region is included in the image to be formed on the recording sheet; and a controller which controls, based on the judgement of said judging means, at least one of said feeding member and said transporting member so that a portion of the recording sheet corresponding to the specific portion of the image is allowed to locate on said inappropriate portion.

17. The image forming apparatus as recited in claim 16, wherein the specific portion is a blank portion located between two colored portions of the image.

18. The image forming apparatus as recited in claim 17, the blank portion extends over an entire width of the recording sheet with respect to a direction perpendicular to a direction of the transport of the transporting member.

19. The image forming apparatus as recited in claim 16, wherein the specific portion is a blank portion located at a portion corresponding to an edge of the recording sheet.

20. The image forming apparatus as recited in claim 19, the blank portion extends over an entire width of the recording sheet with respect to a direction perpendicular to a direction of the transport of the transporting member.

21. The image forming apparatus as recited in claim 20, wherein said controller controls at least one of said feeding member and said transporting member so that the recording sheet is not located on said inappropriate portion in a case where said judging means judges that the image does not include the specific portion.

22. The image forming apparatus as recited in claim 16, wherein the inappropriate portion is a seam.

23. The image forming apparatus as recited in claim 16, wherein said judging means judges, based on the image data, whether the specific portion is included in the image.

24. The image forming apparatus as recited in claim 16, further comprising:

generating means for generating image information based on the image data, wherein said judging means executes the judge based on the image information generated by said generating means.

25. An image forming apparatus, comprising:

a feeding member which feeds a recording sheet placed on a sheet tray;

a transporting member which receives the recording sheet from said feeding member and transports the recording sheet while holding the recording sheet thereon, said transporting member having an inappropriate portion;

an image forming unit which forms, based on image data, an image including a colored portion and a blank portion on the recording sheet held on said transporting member, wherein said image forming unit cannot previously from the colored portion on a portion of the recording sheet which is located on said inappropriate portion; and a controller which controls at least one of said feeding member and said transporting member so that a first portion of the recording sheet corresponding to the blank portion is allowed to locate on said inappropriate portion but a second portion of the recording sheet corresponding to the colored portion is not allowed to locate on said inappropriate portion.

* * * * *